US009481179B2

(12) United States Patent
Masumi et al.

(10) Patent No.: US 9,481,179 B2
(45) Date of Patent: Nov. 1, 2016

(54) INKJET PRINTER AND IMAGE FORMATION METHOD

(71) Applicant: Konica Minolta, Inc., Tokyo (JP)

(72) Inventors: Satoshi Masumi, Sagamihara (JP); Yasuhiro Matsui, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/900,779

(22) PCT Filed: Jun. 30, 2014

(86) PCT No.: PCT/JP2014/003479

§ 371 (c)(1),
(2) Date: Dec. 22, 2015

(87) PCT Pub. No.: WO2015/001790

PCT Pub. Date: Jan. 8, 2015

(65) Prior Publication Data

US 2016/0152034 A1 Jun. 2, 2016

(30) Foreign Application Priority Data

Jul. 2, 2013 (JP) ..... 2013-138890

(51) Int. Cl.
*B41J 2/175* (2006.01)
*B41J 2/155* (2006.01)
*B41J 2/195* (2006.01)

(52) U.S. Cl.
CPC ..... *B41J 2/175* (2013.01); *B41J 2/155* (2013.01); *B41J 2/195* (2013.01)

(58) Field of Classification Search
CPC ..... B41J 2/175
See application file for complete search history.

(56) References Cited

U.S. PATENT DOCUMENTS

| | | | | |
|---|---|---|---|---|
| 8,096,647 | B2 | 1/2012 | Jones | |
| 8,240,830 | B2 | 8/2012 | Jones et al. | |
| 8,403,453 | B2 * | 3/2013 | Takabayashi | B41M 5/0023 347/20 |
| 2006/0038862 | A1 * | 2/2006 | Tanno | B41J 2/17596 347/84 |
| 2009/0189931 | A1 * | 7/2009 | Noro | B41J 2/175 347/7 |
| 2013/0293644 | A1 * | 11/2013 | Anton | C09D 11/322 347/100 |

FOREIGN PATENT DOCUMENTS

| | | | |
|---|---|---|---|
| JP | H09156121 | A | 6/1997 |
| JP | 2003170610 | A | 6/2003 |
| JP | 2011051241 | A | 3/2011 |
| JP | 2012218197 | A | 11/2012 |
| JP | 2013119243 | A | 6/2013 |

OTHER PUBLICATIONS

International Search Report dated Aug. 5, 2014 for PCT/JP2014/003479 and English translation.

* cited by examiner

*Primary Examiner* — Jason Uhlenhake
(74) *Attorney, Agent, or Firm* — Lucas & Mercanti, LLP

(57) ABSTRACT

An object of the invention is to provide an inkjet printer that forms an image with good quality. The object is achieved by an inkjet printer 1 including an ink head H ejecting an ink, an ink supply unit P communicating with the ink head H, and an ink storage unit T communicating with the ink supply unit P and supplying the ink to the ink head H through the ink supply unit P, in which at least a part of the ink supply unit P has an ink heating unit S that heats the ink until a viscosity of the ink is within the range of 5 mPa·s or more to 30 mPa·s or less, and the ink storage unit T has a shearing device that shears the ink.

14 Claims, 4 Drawing Sheets

INKJET PRINTER AND IMAGE FORMATION METHOD

CROSS REFERENCE TO RELATED APPLICATION

This Application is a 371 of PCT/JP2014/003479 filed on Jun. 30, 2014 which, in turn, claimed the priority of Japanese Application No. 2013-138890 filed on Jul. 2, 2013, both applications are incorporated herein by reference.

TECHNICAL FIELD

The present invention relates to an inkjet printer and an image formation method.

BACKGROUND ART

Inkjet recording methods enable simple and inexpensive image production and thus have been used in a variety of printing fields. As an example of the inkjet recording methods, an ultraviolet (UV)-curable inkjet method is known in which droplets of UV-curable inkjet ink are landed on a recording medium and then cured by irradiation with UV rays to form an image. Recently, the UV-curable inkjet method has been attracting attention from the viewpoint that an image having high rubfastness and adhesiveness can be formed even on a recording medium which lacks ink absorbing properties.

There is a demand on an inkjet ink that can be recorded on various recording media other than exclusive paper for inkjet and vinyl chloride for a solvent-based ink. As an ink having a high freedom for selecting a base material, a hot-melt ink and a UV-curable ink are mentioned. Since the hot-melt ink is solid, the ink is supplied in the form of a block shape or a ball shape. The UV-curable ink is directly supplied from an ink cartridge or is introduced to a tank once and then supplied by a pump or the like.

When wax is added to the UV-curable ink, an inkjet ink system is expected which has all of base material selectivity, high-speed printing, and image permanence that are features of each of the hot-melt ink and the UV-curable ink. However, the UV-curable ink added with the wax has a high viscosity and thus cannot be supplied using a liquid sending pump of the related art even at room temperature. For this reason, it is necessary to provide a dedicated facility for sending liquid and thus the facility cost is increased. In addition, if such a UV-curable ink is heated and dissolved in an ink storage unit, the ink storage unit and the whole supply passage including an inkjet head need to be in a heated state, and thus problems arise in terms of safety aspect as well as energy aspect. Several solving means for these problems have been proposed, but the problems have not been solved yet (for example, see Patent Literatures 1 and 2).

CITATION LIST

Patent Literatures

Patent Literature 1: U.S. Pat. No. 8,096,647
Patent Literature 2: U.S. Pat. No. 8,240,830

SUMMARY OF INVENTION

Technical Problem

An object of the invention is to provide an inkjet printer that forms an image with good quality and an image formation method using such an inkjet printer.

Solution to Problem

1. An inkjet printer including: an ink head ejecting an ink; an ink supply unit communicating with the ink head; and an ink storage unit communicating with the ink supply unit and supplying the ink to the ink head through the ink supply unit, wherein the ink supply unit has an ink heating unit that heats the ink until a viscosity of the ink is within the range of 5 mPa·s or more to 30 mPa·s or less, and the ink storage unit has a shearing device that shears the ink.

2. The inkjet printer according to Item. 1, being used for an ink having a viscosity at 25° C. of 5000 mPa·s or more.

3. The inkjet printer according to Item. 1 or 2, wherein the ink storage unit includes a shearing device that has a rotation axis and a rotating blade provided at one end of the rotation axis and a container that accommodates the ink.

4. The inkjet printer according to Item. 3, wherein the container is a substantially cylindrical container, and when a radius of the circle obtained by cutting the container in a horizontal direction with respect to the bottom surface is designated as R and a distance from the rotation axis to the leading end of the rotating blade is designated as r, r/R is equal to or more than 0.5.

5. The inkjet printer according to Item. 4, wherein r/R is 0.60 to 0.77.

6. The inkjet printer according to any one of Items. 3 to 5, wherein, when the distance from the rotation axis to the leading end of the rotating blade is designated as r and a distance from the rotating blade to the bottom surface of the container is designated as d, r/d is 2 to 50.

7. The inkjet printer according to Item. 6, wherein r/d is 4 to 30.

8. The inkjet printer according to any one of Items. 3 to 7, wherein a circumferential velocity of the rotating blade is 100 rpm to 600 rpm.

9. The inkjet printer according to any one of Items. 1 to 8, wherein the shearing device decreases the viscosity of the ink to ⅕ or less of the viscosity of the ink before shearing.

10. The inkjet printer according to any one of Items. 1 to 9, wherein the ink contains a photopolymerizable compound, a photopolymerization initiator, and a gelling agent, and undergoes temperature-induced sol-gel phase transition.

11. An image formation method including, in the following order: a step of shearing an active ray-curable inkjet ink; a step of supplying the sheared active ray-curable inkjet ink to an ink head while the sheared active ray-curable inkjet ink is heated such that a viscosity of the ink is within the range of 5 mPa·s or more to 30 mPa·s or less; a step of ejecting the active ray-curable inkjet ink to a recording medium; and a step of curing the ink by irradiating the ink landed on the recording medium with an active ray.

12. The image formation method according to Item. 11, wherein the viscosity at 25° C. of the active ray-curable inkjet ink is 5000 mPa·s.

13. The image formation method according to Item. 11 or 12, wherein the shearing step is a step of shearing the active ray-curable inkjet ink by using a shearing device that has a rotation axis and a rotating blade provided at one end of the rotation axis.

14. The image formation method according to Item. 13, wherein a circumferential velocity of the rotating blade is 100 rpm to 600 rpm.

15. The image formation method according to any one of Items. 11 to 14, wherein the shearing step decreases the viscosity of the ink to ⅕ or less of the viscosity of the ink before shearing.

Advantageous Effects of Invention

According to the invention, there are provided an inkjet printer that forms an image with good quality and an image formation method using such an inkjet printer.

DESCRIPTION OF EMBODIMENTS

Figure 1:
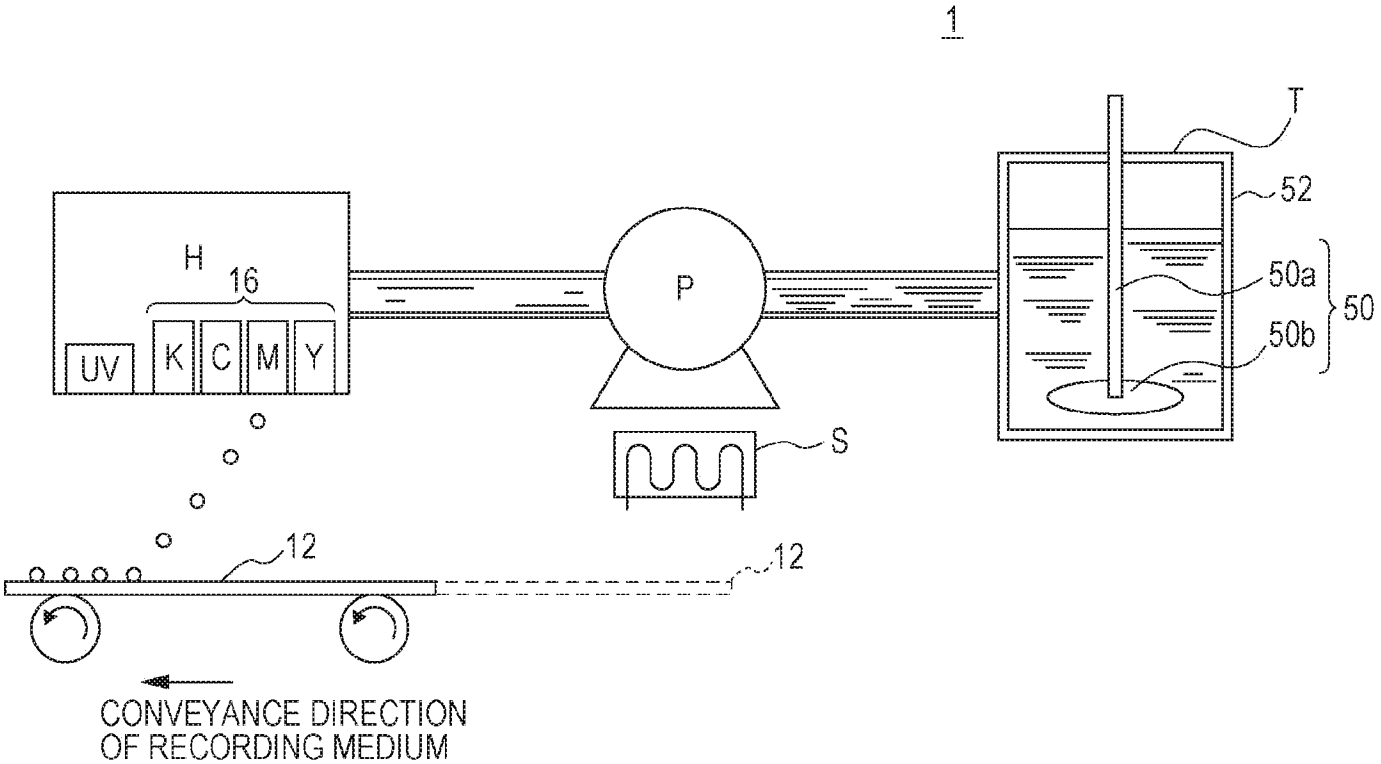
FIG. 1 illustrates a schematic diagram of an inkjet printer according to an embodiment.

Hereinafter, the invention will be described with reference to embodiments. However, the invention is not limited to the following embodiments. Same or similar reference numerals are assigned to components having the same or similar functions in the drawings, and description for these components is not provided. Note that the drawings are schematic. Accordingly, specific dimension and the like should be determined based on the following description. In addition, needless to say, relations between dimensions and ratios may be different among the drawings.

[Inkjet Printer]

As illustrated in FIG. 1, an inkjet printer 1 according to an embodiment includes an ink head H ejecting an ink, an ink supply unit P communicating with the ink head H, and an ink storage unit T communicating with the ink supply unit P and supplying the ink to the ink head H through the ink supply unit P. The ink supply unit P has an ink heating unit S that heats the ink until a viscosity of the ink is within the range of 5 mPa·s or more to 30 mPa·s or less. The ink storage unit T has a shearing device that shears the ink.

In the invention, a viscosity of the ink at each temperature and a gelation temperature thereof can be obtained by measuring a temperature change in dynamic viscoelasticity of the ink using a rheometer. Specifically, a temperature change curve of the viscosity when the ink is heated to 100° C. and cooled to 20° C. with the conditions including a shear rate of 11.7 (1/s) and a temperature decrease rate of 0.1° C./s is obtained. Further, the viscosity at each temperature can be obtained by reading each of the viscosities at each temperature in a temperature change curve of the viscosity. The gelation temperature indicates a temperature at which the viscosity is greatly changed in the temperature change curve of the viscosity and can be defined as a temperature at which the viscosity becomes 200 mPa·s, for example.

The ink supply unit P is not particularly limited as long as it has the ink heating unit S, and a general liquid sending pump can be used. When a general liquid sending pump is used instead of a high-viscosity ink supply means of the related art, the cost of the inkjet printer can be suppressed. As the ink supply unit P, an ink supply unit, which can supply the ink having a viscosity after shearing at 25° C. of about 1000 mPa·s faster than the total ejection speed of a head that receives the supply of the ink, is preferable.

The ink heating unit S is not particularly limited as long as it can heat the ink such that the viscosity of the ink is within the range of 5 mPa·s or more to 30 mPa·s or less, and various heating devices such as a heater can be used. For example, when the ink is heated to a temperature equal to higher than the gelation temperature of the ink+10° C., the viscosity of the ink can be within the range of 5 mPa·s or more to 30 mPa·s or less.

The position of the ink heating unit S disposed with respect to the ink supply unit P is not particularly limited as long as it can heat the ink after shearing, but from the viewpoint of energy saving, the ink heating unit S is preferably disposed in the vicinity of the ink supply unit P. In addition, although not illustrated in the drawing, an ink storage unit may be further provided between the ink heating unit S and the ink head H. Incidentally, the ink heating unit S may be provided in the ink supply unit P in advance or later. The ink heating unit S may be disposed in at least a part of the ink supply unit P, but an additional ink heating unit S may be disposed at a pipe between the ink storage unit T and the ink supply unit P.

The shearing device of the ink storage unit T is not particularly limited as long as it can shear the ink, and various shearing devices can be used. Incidentally, the shearing indicates that an operation of dividing the ink in a direction parallel to an arbitrary plane inside the ink and mixing the divided inks again is repeated. As the shearing device, it is possible to use a device that shears the ink by a rotating blade, a device that shears the ink by a static mixer in which two types of rectangular metal plates each twisted toward a different direction are alternately disposed, or the like. Among these devices, from the viewpoint that a large amount of the ink can be sheared in a short time and the configuration of a device used for shearing can be simplified, the shearing device is preferably a device that shears the ink by a rotating blade.

Figure 2:
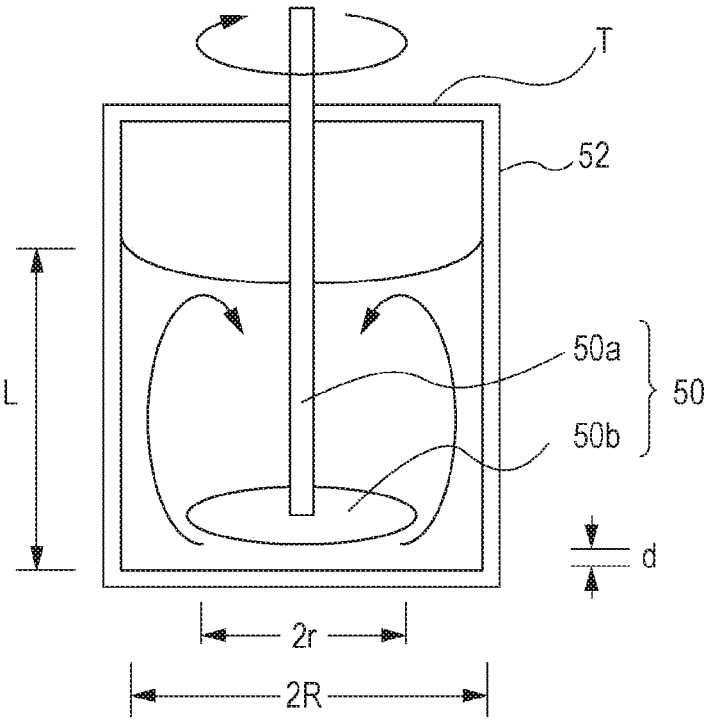
FIG. 2 illustrates a schematic diagram of an ink storage unit of the inkjet printer according to the embodiment.

In a case where the shearing device shears the ink by a rotating blade, as illustrated in FIG. 2, the ink storage unit T includes a shearing device 50 that has a rotation axis 50*a* and a rotating blade 50*b* provided at one end of the rotation axis 50*a*, a driving device (not illustrated) that is provided at the other end of the rotation axis 50*a* and rotates the shearing device 50 about the axis, and a container 52. Regarding the rotating blade 50*b*, a disk-shaped product may be used or a plurality of extended elliptical blades may be combined and then used. The shearing device 50 preferably decreases the viscosity of the ink to at least ⅕.

In a case where the container 52 is substantially cylindrical, the rotation axis 50*a* is preferably disposed to pass through the center of the circle obtained by cutting the container 52. At this time, when a radius of the circle obtained by cutting the container 52 in a horizontal direction with respect to the bottom surface is designated as R and a distance from the rotation axis 50*a* to the leading end of the rotating blade 50*b* (hereinafter, also referred to as a radius of the rotating blade) is designated as r, r/R is preferably equal to or more than 0.5, and more preferably, r/R is 0.60 to 0.77. The reason for this is that, when r/R is too small, a portion which is not sheared is wide and thus it takes time to shear the entire ink. In addition, the reason for this is that, when r/R is more than 0.77, convection efficiency in the container is lowered or torque for rotation is increased.

Regardless of the shape of the container 52, when a distance from the rotating blade 50*b* to the bottom surface of the container 52 is designated as d, r/d is preferably 2 to 50, and more preferably, r/d is 4 to 30. The reason for this is that, when r/d is too small, a pressing force toward the lower portion of the rotating blade becomes weaker, and thus shearing residues of the lower portion of the rotating blade 50*b* occur, and further, a trouble in which the rotating blade comes into contact with the bottom portion of the tank due to the deviation of the rotating blade during rotating occurs. In addition, the reason for this is that, when r/d is too large, a resistance at the time of pressing toward the lower portion is increased and thus circulation efficiency is deteriorated.

The depth L of the liquid at the time of shearing is not particularly limited, but in order to perform efficiently shearing, L/R is preferably 1.0 to 5.0, and more preferably, L/R is 1.5 to 3.0.

The circumferential velocity of the rotating blade is preferably 100 rpm to 600 rpm. The reason for this is that, when the circumferential velocity is slow, it takes time to make the ink uniform, and when the circumferential velocity is fast, a large torque is necessary, or the contamination of the surrounding area due to liquid splash or rolling-in of bubbles occurs. The circumferential velocity is further preferably 150 rpm to 400 rpm.

It is preferable that the ink having a viscosity of 5000 mPa·s or more be introduced into the ink storage unit T so as to be stored and sheared. According to the invention, even when an image is formed by using such an ink having a high viscosity, the liquid is easily sent and an image with small unevenness in density and glossiness can be formed.

(As for One Aspect of Inkjet Printer)

The inkjet printer of active ray-curable inkjet type will be described mainly with respect to one aspect of the ink head H. The inkjet printer of active ray-curable inkjet type includes a line recording type (single pass recording type) inkjet printer and a serial recording type inkjet printer. The type of the inkjet printer may be selected depending on desired image resolution or recording speed, but the line recording type (single pass recording type) is preferable from the viewpoint of high speed recording.

Figure 3A:
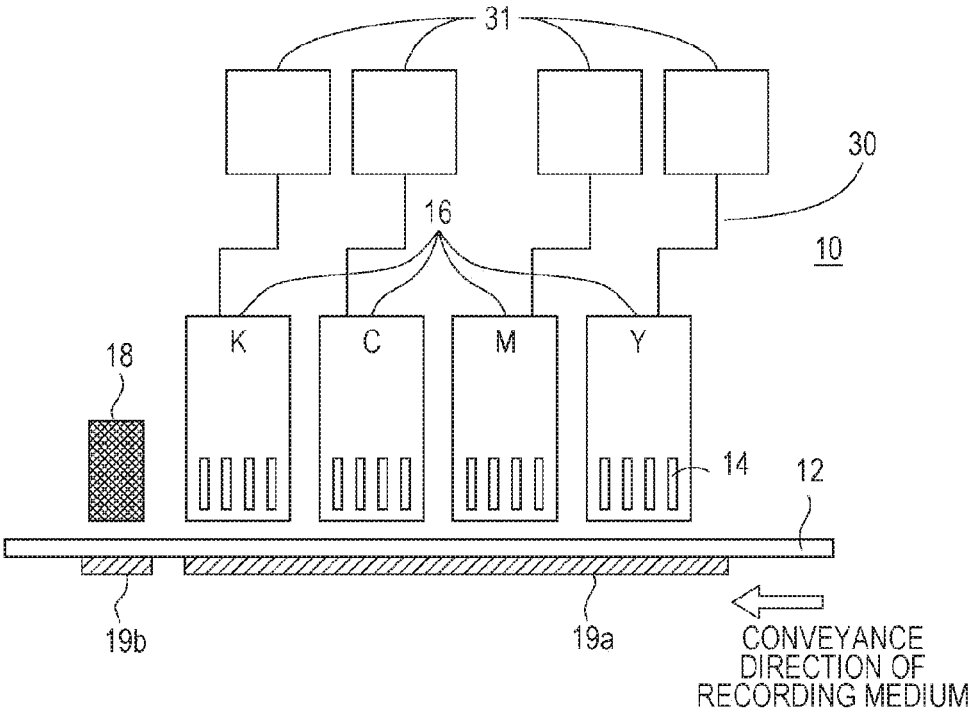
FIG. 3A is a side view illustrating an example of the configuration of main parts of a line recording type inkjet printer.
Figure 3B:
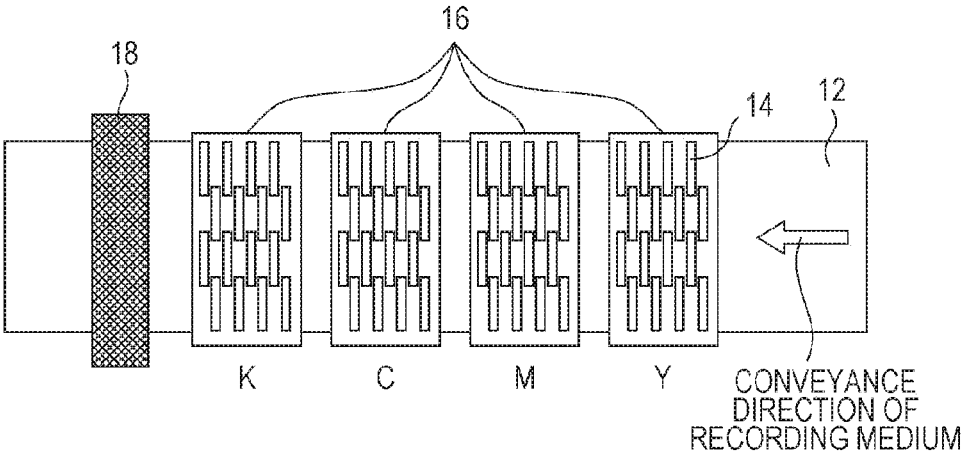
FIG. 3B is a top view illustrating an example of the configuration of main parts of the line recording type inkjet printer.

FIG. 3A and FIG. 3B are diagrams illustrating an example of the configuration of main parts of a line recording type inkjet printer. Of these, FIG. 3A is a side view and FIG. 3B is a top view. As illustrated in FIG. 3A and FIG. 3B, an inkjet printer 10 includes a head carriage 16 accommodating a plurality of inkjet recording heads 14, an active ray irradiation unit 18 covering the entire width of a recording medium 12 and disposed at a downstream side of the head carriage 16 (a conveyance direction of the recording medium), and temperature control units 19 (19*a* and 19*b*) disposed on the lower surface of the recording medium 12.

The head carriage 16 is connected to an ink tank 31 storing an ink via an ink channel 30. The head carriage 16 is fixedly disposed so as to cover the entire width of the recording medium 12 and accommodates the plurality of inkjet recording heads 14 that are provided for each color. The inkjet recording heads 14 are designed to be supplied with an ink. For example, an ink may be supplied directly from an ink cartridge (not illustrated) detachably attached to the inkjet printer 10 and the like, or by an ink supply means (not illustrated).

The plurality of inkjet recording heads 14 are disposed for each color in the conveyance direction of the recording medium 12. The number of the inkjet recording heads 14 disposed in the conveyance direction of the recording medium 12 is set based on the nozzle density of the inkjet recording head 14 and the resolution of a printed image. For example, in a case where an image having a resolution of 1440 dpi is formed by using the inkjet recording head 14 with a drop volume of 2 pl and a nozzle density of 360 dpi, four inkjet recording heads 14 may be disposed in a staggered manner with respect to the conveyance direction of the recording medium 12.

Furthermore, in a case where an image having a resolution of 720×720 dpi is formed by using the inkjet recording head 14 with a drop volume of 6 pl and a nozzle density of 360 dpi, two inkjet recording heads 14 may be disposed in a staggered manner. The term "dpi" represents the number of ink droplets (dots) per inch (2.54 cm).

The active ray irradiation unit 18 covers the entire width of the recording medium 12 and is disposed at the downstream side of the head carriage 16 with respect to the conveyance direction of the recording medium. The active ray irradiation unit 18 radiates an active ray to liquid droplets which have been ejected from the inkjet recording head 14 and landed on the recording medium 12 so as to cure the liquid droplets.

In a case where the active ray is a UV ray, examples of the active ray irradiation unit 18 (a UV irradiation means) include a fluorescent tube (a low-pressure mercury lamp or a germicidal lamp), a cold cathode tube, a UV laser, a low-, medium-, or high-pressure mercury lamp having an operating pressure of several 100 Pa to 1 MPa, a metal halide lamp, and an LED. From the viewpoint of curability, a UV irradiation means for radiating a UV ray with an illuminance of 100 mW/cm$^2$ or more; specifically, a high-pressure mercury lamp, a metal halide lamp, an LED, and the like are preferable. Among the UV irradiation means, an LED is particularly preferable from the viewpoint of low power consumption and reduced radiation heat. Specific examples of the LED as the UV irradiation means include water-cooled 395-nm LED manufactured by Phoseon Technology.

In a case where the active ray is an electron beam, examples of the active ray irradiation unit 18 (an electron beam irradiation means) include an electron beam irradiation means using a scanning method, a curtain beam method, a broad beam method, or the like, but from the viewpoint of processing capacity, an electron beam irradiation means using a curtain beam method is preferable. Examples of the electron beam irradiation means include "CURETRON EBC-200–20–30" manufactured by Nisshin High Voltage Corp. and "Min-EB" manufactured by AIT Corp.

The temperature control units 19 (19*a* and 19*b*) are disposed on the lower surface of the recording medium 12 and maintain the recording medium 12 at a predetermined temperature. The temperature control units 19 may be various heaters or the like, for example.

Hereinafter, an image recording method using the line recording type inkjet printer 10 will be described. The recording medium 12 is conveyed between the head carriage 16 and the temperature control unit 19*a* of the inkjet printer 10. Meanwhile, the temperature of the recording medium 12 is adjusted to a predetermined temperature by the temperature control unit 19*a*. Next, an ink at a high temperature is ejected from the inkjet recording head 14 of the head carriage 16 and attached to (landed on) the recording medium 12. Then, the ink droplets that have been attached to the recording medium 12 are irradiated with an active ray by the active ray irradiation unit 18 so as to cure the ink droplets.

The temperature of the ink inside the inkjet recording head 14 at the time of ejecting the ink from the inkjet recording head 14 is preferably set to a temperature higher than the gelation temperature of the ink by 10 to 30° C. in order to improve the ejectability of the ink. When the temperature of the ink inside the inkjet recording head 14 is lower than (the gelation temperature+10)° C., the gelation of the ink occurs in the inkjet recording head 14 or on the surface of the nozzle, and thus the ejectability of the ink is likely to decrease. On the other hand, when the temperature of the ink inside the inkjet recording head 14 is higher than (the gelation temperature+30)° C., the temperature of the ink is too high, and thus the ink components may deteriorate in some cases.

The drop volume per one droplet that is ejected from each nozzle of the inkjet recording head 14 varies depending on the resolution of an image, but in order to form an image with a high resolution, the drop volume is preferably 0.5 pl to 10 pl and more preferably 1 pl to 4.0 pl.

In order to suppress combining of adjacent ink droplets, irradiation with the active ray from the active ray irradiation unit 18 is preferably carried out within 10 seconds, preferably within 0.001 seconds to 5 seconds, and more preferably within 0.01 seconds to 2 seconds after the ink droplets are attached onto the recording medium. The irradiation with the active ray is preferably carried out after the ink is ejected from all inkjet recording heads 14 accommodated in the head carriage 16. At this time, the temperature of the recording medium 12 is appropriately adjusted by the temperature control unit 19*b*. The temperature of the recording medium 12 at this time may be a temperature of the recording medium 12 at the time of ejecting the ink; that is, may be the same as or different from a temperature to be adjusted by the temperature control unit 19*a*.

In a case where the active ray is an electron beam, in order to achieve sufficient curing, the accelerating voltage of the electron beam irradiation is preferably set to 30 to 250 kV, and more preferably set to 30 to 100 kV. When the accelerating voltage is 100 to 250 kV, the amount of the electron beam irradiation is preferably 30 to 100 kGy and more preferably 30 to 60 kGy.

The total film thickness of the image after the ink curing is preferably 2 to 25 μm. The term "total film thickness" is a maximum film thickness of the cured product of the ink landed on the recording medium.

Figure 4:
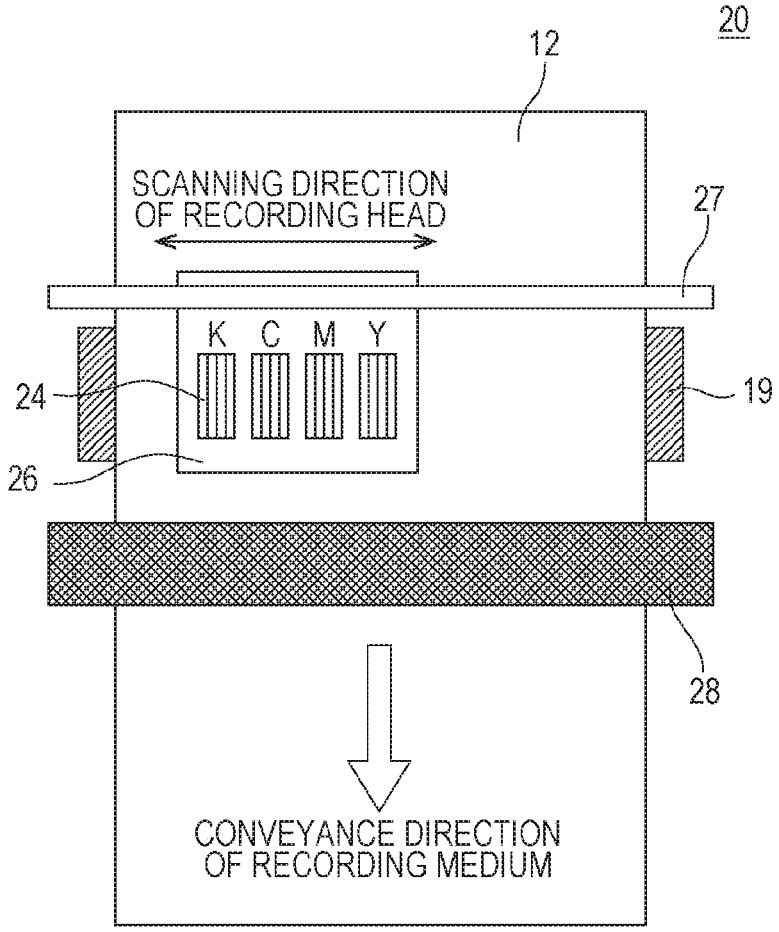
FIG. 4 is a diagram illustrating an example of the configuration of main parts of a serial recording type inkjet printer.

FIG. 4 is a diagram illustrating an example of the configuration of main parts of a serial recording type inkjet printer 20. As illustrated in FIG. 4, the inkjet printer 20 may be configured in the same manner as in FIG. 2, except that the inkjet printer includes a head carriage 26 having a width smaller than the entire width of the recording medium and accommodating the plurality of inkjet recording heads 24, instead of the head carriage 16 that is fixedly disposed so as to cover the entire width of the recording medium, and a guide portion 27 for moving the head carriage 26 in the width direction of the recording medium 12.

In the serial recording type inkjet printer 20, while the head carriage 26 is moved along the guide portion 27 in the width direction of the recording medium 12, the ink is ejected from the inkjet recording heads 24 accommodated in the head carriage 26. Each time after the head carriage 26 moves completely in the width direction of the recording medium 12 (for each pass), the recording medium 12 is fed in the conveyance direction. Thereafter, an active ray irradiation unit 28 carries out irradiation with an active ray. Except these operations, an image is recorded in almost the same manner as in the line recording type inkjet printer 10 described above.

[Active Ray-Curable Ink]

An active ray-curable ink to be used in the inkjet printer according to the embodiment is preferably an active ray-curable inkjet ink that contains a gelling agent, a photopolymerizable compound, and a photopolymerization initiator, and undergoes temperature-induced sol-gel phase transition.

(Photopolymerizable Compound)

The photopolymerizable compound is a compound that is crosslinked or polymerized by irradiation with an active ray. Examples of the active ray include an electron beam, a UV ray, an α ray, a γ ray, and an X ray, and a UV ray is preferable.

The photopolymerizable compound to be used in the active ray-curable inkjet ink is not particularly limited, but examples thereof may include the following polymerizable compound A and polymerizable compound B.

1) Polymerizable compound A in which C log P is within the range of −4.0 or more to less than 1.0 and which has a (meth)acrylamide group in the molecule 2) Polymerizable compound B in which C log P is within the range of −1.0 or more to less than 4.0 and a molecular weight is 200 or more but less than 1200 and which has a (meth)acrylate group in the molecule Here, the term "(meth)acrylate" refers to both or one of "acrylate" and "methacrylate," and the term "(meth)acryl" refers to both or one of "acryl" and "methacryl."

Furthermore, the term "log P value" is a coefficient indicating the affinity of an organic compound to water and 1-octanol. The 1-octanol/water partition coefficient P is a partition equilibrium achieved when a trace amount of a compound is dissolved as a solute in a two-liquid phase solvent of 1-octanol and water, and the partition coefficient P is the ratio of equilibrium concentrations of the compound in the respective solvents, and is expressed as log P, the logarithm to the base 10 of the partition coefficient. That is, the term "log P value" is a logarithmic value of the partition coefficient of 1-octanol/water, and is known as an important parameter indicating the hydrophilicity and hydrophobicity of a molecule.

The term "C log P value" is a log P value obtained by calculation. The C log P value may be calculated by a fragment method, an atomic approach method, or the like. More specifically, in order to calculate the C log P value, a fragment method described in the literature (C. Hansch and A. Leo, "Substituent Constants for Correlation Analysis in Chemistry and Biology" (John Wiley & Sons, New York, 1969)) or commercially available software package 1 or 2 described below may be used.

Software package 1: MedChem Software (Release 3.54, August 1991, Medicinal Chemistry Project, Pomona College, Claremont, Calif.)

Software package 2: Chem Draw Ultra ver. 8.0. (April 2003, CambridgeSoft Corporation, USA)

The numerical value of the C log P value described in the specification of the present application is a "C log P value" calculated using software package 2.

In a sol-gel phase transition type UV-curable ink of the related art, the compatibility between the gelling agent and the photopolymerizable compound has not been studied in detail. For this reason, in a case where the photopolymerizable compound and the gelling agent are difficult to be compatible with each other, there is a problem that the ejection of the ink becomes unstable, the gelling agent cannot form a desired gel structure (a card house structure or a fibrous network structure), or the ink droplets after landing are difficult to undergo gelation. On the other hand, in a case where the compatibility between the gelling agent and the photopolymerizable compound is too high, there is a problem that the gelling agent cannot be sufficiently crystallized after the ink is landed on the recording medium. In addition, at the initial stage of printing, although the gelling agent is compatible with the photopolymerizable compound, the gelling agent is gradually difficult to be compatible with the photopolymerizable compound while the printing is continued, and thus the ejectability of the ink is decreased, for example.

In this regard, the present inventors found that, when a certain amount of the polymerizable compound A and a certain amount of the polymerizable compound B are used together with the gelling agent, the gelling agent is stably compatible with the polymerizable compound, the ejectability of the ink is improved, the gelling agent is rapidly crystallized after the ink is landed on the recording medium, and combining of liquid droplets can be suppressed. The reason for this is speculated as follows.

The polymerizable compound A (a (meth)acrylamide compound) has relatively high hydrophilicity. On the other hand, the polymerizable compound B (a (meth)acrylate compound) has relatively high hydrophobicity. Both of these polymerizable compound A and polymerizable compound B have a (meth)acryloyl group and are easily compatible with each other. On the other hand, the gelling agent contained in the active ray-curable inkjet ink has both of a hydrophobicity part and a hydrophilicity part in the molecular structure thereof. The hydrophobicity part and the hydrophilicity part of the gelling agent are easily compatible with the polymerizable compound B and the polymerizable compound A, respectively. For this reason, in the sol-state ink, the gelling agent can stably exist.

On the other hand, since the polymerizable compound A having high hydrophilicity is contained in the ink, when the ink is landed on the recording medium, the gelling agent is rapidly precipitated and crystallized. That is, combining of droplets after landing is suppressed and thus an image with high quality is obtained.

Furthermore, since the polymerizable compound A (an acrylamide compound) is contained in the active ray-curable inkjet ink, the adhesiveness between the ink after curing (a printed image) and the recording medium is favorable. In addition, the scratch resistance of a cured film is further improved. Moreover, since the polymerizable compound B having high flexibility is contained, the flexibility (bending resistance) of the printed image is also favorable.

(Polymerizable Compound A)

The polymerizable compound A is a (meth)acrylamide compound. As described above, when the polymerizable compound A is contained in the active ray-curable inkjet ink, the adhesiveness between the ink after curing and the recording medium is increased. Further, the scratch resistance of the cured film of the ink is also increased.

The C log P value of the polymerizable compound A is −4.0 or more but less than 1.0, and more preferably −3.0 or more but less than 1.0. When the C log P value of the polymerizable compound A is less than −4.0, the hydrophilicity is excessively increased and thus the compatibility with the gelling agent or the polymerizable compound B is decreased. For this reason, the solubility of the gelling agent becomes unstable, and thus there are cases where the ejectability of the ink becomes unstable, a desired gel structure (a card house structure or a fibrous network structure) is not formed after the ink is landed on the recording medium, and combining of dots cannot be suppressed. On the other hand, when the C log P value of the polymerizable compound A is 1.0 or more, the adhesiveness between the printed image and the recording medium is difficult to be increased.

The number of the (meth)acrylamide groups contained in the molecule of the polymerizable compound A is not particularly limited. Only one (meth)acrylamide group or two or more (meth)acrylamide groups may be contained in the polymerizable compound A.

The molecular weight of the polymerizable compound A is not particularly limited, but is preferably 100 or more but less than 1000, and more preferably 100 or more but less than 500. In an acrylamide compound having a molecular weight of 100 or less, there is a compound having a biohazardous property. On the other hand, when the molecular weight of the acrylamide compound is 1000, the viscosity of the ink is likely to be excessively increased.

Preferred examples of the polymerizable compound A include the following compounds. However, the polymerizable compound A is not limited to the following compounds:

N,N-dimethylacrylamide (molecular weight: 99, C log P value: −0.17), N,N-diethylacrylamide (molecular weight: 127, C log P value: 0.89), acryloylmorpholine (molecular weight: 141, C log P value: −0.07), N-(2-hydroxyethyl) acrylamide (molecular weight: 115, C log P value: −1.03), N-isopropylacrylamide (molecular weight: 113, C log P value: 0.25), diacetone acrylamide (molecular weight: 169, C log P value: 0.29), N-methylolacrylamide (molecular weight: 101, C log P value: −0.93), N-[3-(dimethylamino) propyl]acrylamide (molecular weight: 156, C log P value: 0.20), N,N'-methylenebisacrylamide (molecular weight: 154, C log P value: −0.92), N,N'-(1,2-dihydroxyethylene) bisacrylamide (molecular weight: 200, C log P value: −3.00), N,N'-ethylenebisacrylamide (molecular weight: 154, C log P value: −0.94), N,N'-propylenebisacrylamide (molecular weight: 182, C log P value: −0.43), N,N'-dimethylmethacrylamide (molecular weight: 113, C log P value: 0.14), and N-(2-hydroxyethyl)methacrylamide (molecular weight: 129, C log P value: −0.17).

N-{3-[4-(3-acryloylamino-2-hydroxy-propoxy)-butoxy]-2-hydroxy-propyl}-acrylamide (molecular weight: 344, C log P value: −2.09) represented by the following General Formula (1)

[Chemical Formula 1]

(1)

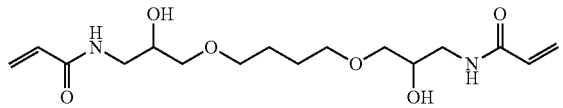

N-(3-{2-[2-(3-acryloylamino-propoxy)-ethoxy]-ethoxy}-propyl)-acrylamide (molecular weight: 328, C log P value: −0.32) represented by the following General Formula (2)

[Chemical Formula 2]

(2)

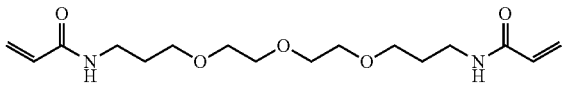

N-{2-[2-(2-acryloylamino-ethoxy)-ethoxy]-ethyl}-acrylamide (molecular weight: 256, C log P value: −0.76) represented by the following General Formula (3)

[Chemical Formula 3]

(3)

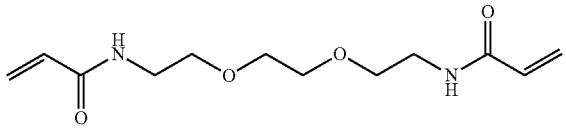

N-{3-[2-(3-acryloylamino-propoxy)-ethoxy]-propyl}-acrylamide (molecular weight: 284, C log P value: −0.19) represented by the following General Formula (4)

[Chemical Formula 4]

(4)

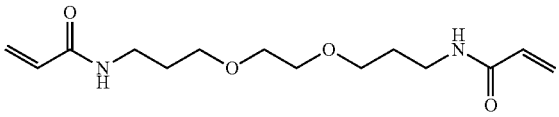

N-{3-[2-(3-acryloylamino-2-hydroxy-propoxy)-ethoxy]-2-hydroxy-propyl}-acrylamide (molecular weight: 316, C log P value: −2.41) represented by the following General Formula (5)

[Chemical Formula 5]

(5)

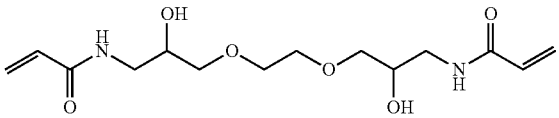

N-{3-[3-(3-acryloylamino-2-hydroxy-propoxy)-2,2-bis-(3-acryloylamino-2-hydroxy-propoxymethyl)-propoxy]−2-hydroxy-propyl}-acrylamide (molecular weight: 645, C log P value: −3.81) represented by the following General Formula (6)

[Chemical Formula 6]

(6)

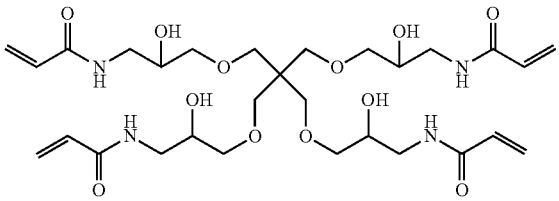

N-{3-[2-(3-acryloylamino-2-hydroxy-propoxy)-1-(2-hydroxy-5-oxo-hepto-6-enyloxymethyl)-ethoxy]−2-hydroxy-propyl}-acrylamide (molecular weight: 472, C log P value: −3.05) represented by the following General Formula (7)

[Chemical Formula 7]

(7)

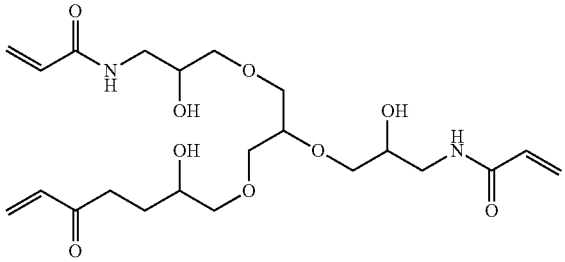

N-[2-(2-[2-{2-{2-(acryloylamino-methoxy)-ethoxy]-ethoxymethyl}−2-[2-(acryloylamino-methoxy)-ethoxymethyl]-butoxy}-ethoxy)-ethoxymethyl]-acrylamide (molecular weight: 604, C log P value: −0.62) represented by the following General Formula (8)

[Chemical Formula 8]

(8)

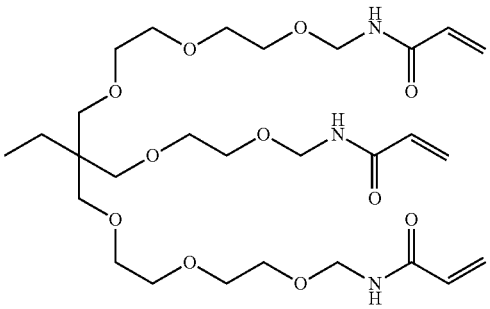

N-{3-[2,2-bis-(3-acryloylamino-2-hydroxy-propoxymethyl)-butoxy]-2-hydroxy-propyl}-acrylamide (molecular weight: 516, C log P value: −1.56) represented by the following General Formula (9)

[Chemical Formula 9]

(9)

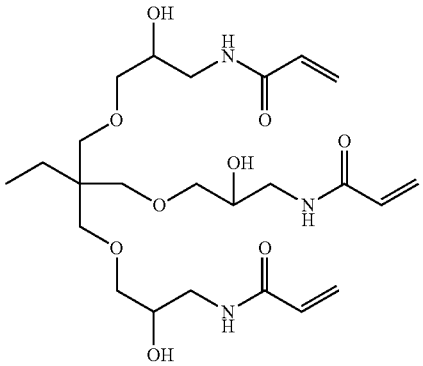

N-{2-[2-(2-{2-[2-(acryloylamino-methoxy)-ethoxy]-ethoxy}−1-{2-[2-(acryloylamino-methoxy)-ethoxy]-ethoxymethyl}-ethoxy)-ethoxy]-ethoxymethyl}-acrylamide (molecular weight: 606, C log P value: −2.99) represented by the following General Formula (10)

[Chemical Formula 10]

(10)

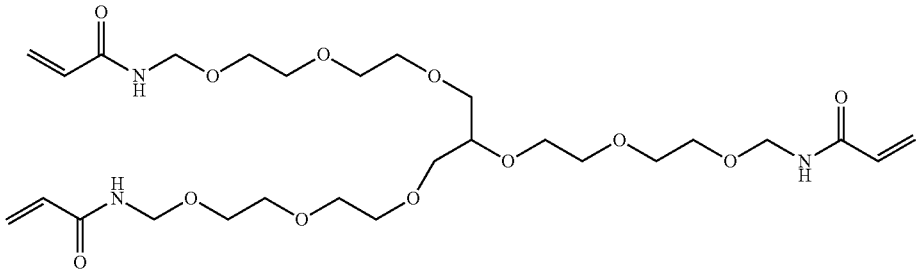

N-(2-{3-[2-(acryloylamino-methoxy)-ethoxy]−2,2-bis-[2-(acryloylamino-methoxy)-ethoxymethyl]-propoxy}-ethoxymethyl)-acrylamide (molecular weight: 645, C log P value: −2.20) represented by the following General Formula (11)

[Chemical Formula 11]

(11)

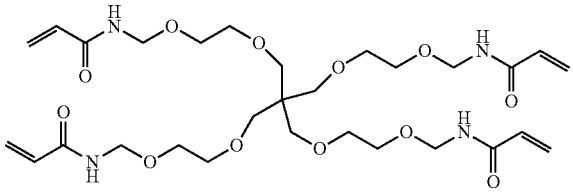

The content of the polymerizable compound A is preferably 5% by mass or more but less than 50% by mass, and more preferably 10 to 40% by mass with respect to the total mass of the active ray-curable inkjet ink. When the content of the polymerizable compound A is 50% by mass or more, the hydrophilicity of the ink is increased and the solubility of the gelling agent is likely to become unstable. For this reason, the ejection of the ink becomes unstable or a gel structure (a card house structure or a fibrous network structure) is not sufficiently formed in the ink droplets after landing, and thus combining of dots is difficult to be suppressed. On the other hand, when the amount of the polymerizable compound A is less than 5% by mass, the adhesiveness between the cured film of the ink and the recording medium is not sufficiently increased.

(Polymerizable Compound B)

The polymerizable compound B is a (meth)acrylate compound. When the polymerizable compound B is contained in the active ray-curable inkjet ink, the gelling agent is stably dissolved in the ink. In addition, when the polymerizable compound B is contained, the flexibility of the cured film of the ink is increased. The C log P value of the polymerizable compound B is −1.0 or more but less than 4.0, and preferably 0 or more but less than 3.6. When the C log P value of the (meth)acrylate compound is less than −1.0, the polymerizable compound B and the gelling agent are difficult to be compatible with each other. For this reason, the ejection of the ink becomes unstable or a gel structure (a card house structure or a fibrous network structure) is not sufficiently formed in the ink droplets after landing, and thus combining of dots is difficult to be suppressed. On the other hand, when the C log P value of the (meth)acrylate compound is 4.0 or more, the polymerizable compound A and the polymerizable compound B are difficult to be compatible with each other.

The molecular weight of the polymerizable compound B is 200 or more but less than 1200, and preferably 300 or more but less than 800. When the molecular weight of the polymerizable compound B is less than 200, the polymerizable compound B is likely to be volatilized in the inkjet printer and thus the ejection of the ink is likely to become unstable. On the other hand, when the molecular weight of the (meth)acrylate compound is more than 1200, the viscosity of the ink is excessively increased and thus the ejection of the ink is likely to become unstable.

The number of the (meth)acrylate groups included in the molecule of the polymerizable compound B is not particularly limited, but the polymerizable compound B preferably has two or more (meth)acrylate groups in the molecule. Specifically, the polymerizable compound B preferably has two, three, or four (meth)acrylate groups from the viewpoint of ink curability.

Preferred examples of the polymerizable compound B include the following compounds. However, the polymerizable compound B is not limited to the following compounds:

4EO modified pentaerythritol tetraacrylate (SR494, manufactured by Sartomer, molecular weight: 528, C log P value: 2.28), tetraethylene glycol diacrylate (V#335HP, manufactured by Osaka Organic Chemical Industry Ltd., molecular weight: 302, C log P value: 1.15), polyethylene glycol #400 diacrylate (NK Ester A-400, manufactured by Shin Nakamura Chemical Co., Ltd., molecular weight: 508, C log P value: 0.47), polyethylene glycol #600 diacrylate (NK Ester A-600, manufactured by Shin Nakamura Chemical Co., Ltd., molecular weight: 708, C log P value: −0.16), polyethylene glycol #200 dimethacrylate (NK Ester 4G, manufactured by Shin Nakamura Chemical Co., Ltd., molecular weight: 330, C log P value: 0.59), polyethylene glycol #400 dimethacrylate (NK Ester 9G, manufactured by Shin Nakamura Chemical Co., Ltd., molecular weight: 536, C log P value: 1.09), 4EO modified hexanediol diacrylate (CD561, manufactured by Sartomer, molecular weight: 358, C log P value: 2.52), 3EO modified trimethylolpropane triacrylate (SR454, manufactured by Sartomer, molecular weight: 429, C log P value: 3.97), 6EO modified trimethylolpropane triacrylate (SR499, manufactured by Sartomer, molecular weight: 560, C log P value: 3.57), tripropylene glycol diacrylate (APG-200, manufactured by Shin Nakamura Chemical Co., Ltd., molecular weight: 300, C log P value: 2.21), tris(2-hydroxyethyl)isocyanurate triacrylate (SR368, manufactured by Sartomer, molecular weight: 423, C log P value: 2.59), glycerin propoxy acrylate (OTA480, manufactured by DAICEL-CYTEC Company, Ltd., molecular weight: 428, C log P value: 2.66), dioxane glycol diacrylate (CD536, manufactured by Sartomer, molecular weight: 326, C log P value: 3.03), 3PO modified neopentyl glycol diacrylate (SR9003, manufactured by Sartomer, molecular weight: 328, C log P value: 3.38), dipropylene glycol diacrylate (APG-100, manufactured by Shin Nakamura Chemical Co., Ltd., molecular weight: 242, C log P value: 2.04), neopentyl glycol diacrylate (A-NPG, manufactured by Shin Nakamura Chemical Co., Ltd., molecular weight: 212, C log P value: 2.58), 2-hydroxy-3-acryloyloxy propylmethacrylate (701A, manufactured by Shin Nakamura Chemical Co., Ltd., molecular weight: 214, C log P value: 0.84), glycerin dimethacrylate (701, manufactured by Shin Nakamura Chemical Co., Ltd., molecular weight: 228, C log P value: 1.15), 1,6-hexanediol diacrylate (A-HD, manufactured by Shin Nakamura Chemical Co., Ltd., molecular weight: 226, C log P value: 3.02), caprolactone acrylate (SR495B, manufactured by Sartomer, molecular weight: 344, C log P value: 2.09), phenol 4EO modified acrylate (Miramer M144, manufactured by Miwon Specialty Chemical Co., Ltd., molecular weight: 324, C log P value: 2.45), methoxytriethylene glycol acrylate (AM-30G, manufactured by Shin Nakamura Chemical Co., Ltd., molecular weight: 218, C log P value: 0.49), methoxytriethylene glycol methacrylate (V-MTG, manufactured by Osaka Organic Chemical Industry Ltd., molecular weight: 232, C log P value: 0.79), alkoxylated neopentyl glycol diacrylate (for example, manufactured by Sartomer, CD9043 or CD9045), EO modified pentanediol di(meth)acrylate, EO modified hexanediol di(meth)acrylate, EO modified trimethylolpropane tri(meth)acrylate, EO modified pentaerythritol tri (meth)acrylate, EO modified pentaerythritol tetra(meth) acrylate, and tetramethylolmethane triacrylate.

The polymerizable compound B preferably includes three or more but less than 25 structures represented by ($CH_2$—$CH_2$—O—) in the molecule, and more preferably includes three or more but less than 15 structures. When three or more structures represented by (—$CH_2$—$CH_2$—O—) are included in the molecule of the polymerizable compound B, the flexibility of the cured film of the ink is increased. On the other hand, when 25 or more structures represented by (—$CH_2$—$CH_2$—O—) are included in the molecule of the polymerizable compound B, there is a concern that the hydrophilicity of the polymerizable compound B is likely to be excessively increased and the polymerizable compound B is difficult to be compatible with the gelling agent.

In this regard, the polymerizable compound B is more preferably tetraethylene glycol diacrylate (V#335HP, manufactured by Osaka Organic Chemical Industry Ltd., molecular weight: 302, C log P value: 1.15), polyethylene glycol #400 diacrylate (NK Ester A-400, manufactured by Shin Nakamura Chemical Co., Ltd., molecular weight: 508, C log P value: 0.47), polyethylene glycol #600 diacrylate (NK Ester A-600, manufactured by Shin Nakamura Chemical Co., Ltd., molecular weight: 708, C log P value: −0.16), polyethylene glycol #200 dimethacrylate (NK Ester 4G, manufactured by Shin Nakamura Chemical Co., Ltd., molecular weight: 330, C log P value: 0.59), polyethylene glycol #400 dimethacrylate (NK Ester 9G, manufactured by Shin Nakamura Chemical Co., Ltd., molecular weight: 536, C log P value: 1.09), 4EO modified hexanediol diacrylate (CD561, manufactured by Sartomer, molecular weight: 358, C log P value: 2.52), 3EO modified trimethylolpropane triacrylate (SR454, manufactured by Sartomer, molecular weight: 429, C log P value: 3.97), or 6EO modified trimethylolpropane triacrylate (SR499, manufactured by Sartomer, molecular weight: 560, C log P value: 3.57).

The content of the polymerizable compound B is 10% by mass or more but less than 70% by mass, and more preferably 20 to 50% by mass with respect to the total mass of the active ray-curable inkjet ink. When the content of the polymerizable compound B is 70% by mass or more, the amount of the polymerizable compound A having an acrylamide group is relatively decreased and the adhesiveness to the recording medium is difficult to be increased. On the other hand, when the content of the polymerizable compound B is less than 10% by mass, the solubility of the gelling agent becomes unstable and the ink ejection is likely to become unstable. In addition, the flexibility of the printed image is not sufficiently increased and thus the bending property of a printed article is decreased.

(Other Polymerizable Compound)

A photopolymerizable compound other than the polymerizable compound A and the polymerizable compound B may be further contained in the active ray-curable inkjet ink. The other polymerizable compound may be a radical polymerizable compound.

The other polymerizable compound may be a compound (a monomer, an oligomer, a polymer, or a mixture thereof) which has a radically polymerizable ethylenically unsaturated bond. Only one type or two or more types of the other polymerizable compounds may be contained in the active ray-curable inkjet ink.

Examples of the other polymerizable compound (the compound having an ethylenically unsaturated bond) include unsaturated carboxylic acid and a salt thereof, an unsaturated carboxylic ester compound, an unsaturated carboxylic urethane compound, an unsaturated carboxylic amide compound and an anhydride thereof, acrylonitrile, styrene, unsaturated polyester, unsaturated polyether, unsaturated polyamide, and unsaturated urethane. Examples of the unsaturated carboxylic acid include (meth)acrylic acid, itaconic acid, crotonic acid, isocrotonic acid, and maleic acid.

The other polymerizable compound is particularly preferably a (meth)acrylate monomer and/or oligomer, and other polymerizable oligomers.

Examples of the (meth)acrylate monomer and/or oligomer include monofunctional monomers such as isoamyl (meth)acrylate, behenyl (meth)acrylate, stearyl (meth)acrylate, lauryl (meth)acrylate, octyl (meth)acrylate, decyl (meth)acrylate, dodecyl (meth)acrylate, isooctyl (meth) acrylate, isomyristyl (meth)acrylate, isostearyl (meth)acrylate, 2-acryloyloxyethyl hexahydrophthalic acid, 2-acryloyloxyethyl succinic acid, 2-acryloyloxyethyl phthalic acid, 2-acryloyloxy ethyl-2-hydroxyethyl-phthalic acid, lactone-modified flexible acrylate, 2-ethylhexyl (meth)acrylate, 2-ethylhexyl-diglycol (meth)acrylate, 2-hydroxybutyl (meth)acrylate, butoxyethyl (meth)acrylate, ethoxy diethylene glycol (meth)acrylate, methoxy diethylene glycol (meth) acrylate, methoxypropylene glycol (meth)acrylate, N-vinyl caprolactam, dimethylaminoethyl (meth)acrylate, dicyclopentenyl (meth)acrylate, dicyclopentenyl oxyethyl (meth) acrylate, phenoxyethyl (meth)acrylate, tetrahydrofurfuryl (meth)acrylate, isobornyl (meth)acrylate, cyclohexyl (meth) acrylate, ethylcarbitol (meth)acrylate, benzyl acrylate, γ-butyrolactone (meth)acrylate, morpholine (meth)acrylate, nonylphenol EO modified (meth)acrylate, 2-hydroxyethyl (meth)acrylate, 2-hydroxypropyl (meth)acrylate, 2-hydroxy-3-phenoxypropyl (meth)acrylate, and t-butylcyclohexyl (meth)acrylate;

bifunctional monomers such as 1,4-butanediol di(meth) acrylate, 1,9-nonanediol di(meth)acrylate, 1,10-decanediol di(meth)acrylate, 1,12-dodecanediol di(meth)acrylate, dimethylol-tricyclodecane di(meth)acrylate, bisphenol A-PO adduct diacrylate, hydroxy pivalic acid neopentyl glycol diacrylate, and polytetramethylene glycol diacrylate;

trifunctional or higher-functional monomers such as PO modified trimethylolpropane tri(meth)acrylate, PO modified pentaerythritol tri(meth)acrylate, PO modified pentaerythritol tetra(meth)acrylate, PO modified dipentaerythritol hexa (meth)acrylate, ditrimethylolpropane tetra(meth)acrylate, glycerinpropoxy tri(meth)acrylate, caprolactone modified trimethylolpropane tri(meth)acrylate, and caprolactam modified dipentaerythritol hexa(meth)acrylate; and oligomers thereof.

Examples of the other polymerizable oligomers include epoxy acrylate, aliphatic urethane acrylate, aromatic urethane acrylate, polyester acrylate, and straight-chain acrylic oligomers.

(Gelling Agent)

A gelling agent is contained in the active ray-curable inkjet ink. According to this, the ink undergoes temperature-induced reversible sol-gel phase transition. The sol-gel phase transition described in the invention indicates a phenomenon in which the ink is in a solution state having fluidity at a high temperature, but when the ink is cooled to a temperature equal to or lower than the gelation temperature, the whole liquid undergoes gelation so as to be changed to a state where the ink lacks fluidity, and when the ink is heated to a temperature equal to or higher than the solation temperature, the ink returns to a liquid state having fluidity.

The gelation described in the invention indicates a case where any of the following structures is formed.

1) Lamella structure

2) Polymer network structure formed by a non-covalent bond or a hydrogen bond

3) Polymer network structure formed by a physical aggregation state

4) Structure in which independent movement of a substance is lost by an interaction of aggregation structures of fine particles or an interaction of precipitated fine crystals That is, the gel indicates a solid or semi-solid state, or thickening state in association with rapid increase in viscosity or increase in elasticity. On the other hand, the sol indicates a state where the interaction formed by gelation is released and the liquid has fluidity.

When the ink undergoes gelation after the ink is landed on the recording medium, combining of adjacent dots is suppressed and thus the image quality is enhanced. In addition, when the ink undergoes gelation, oxygen is less likely to be diffused in the ink droplets. For this reason, the photopolymerization of the photopolymerizable compound is less likely to be inhibited by oxygen, and the curability of the ink is also increased.

The added amount of the gelling agent of the active ray-curable inkjet ink in the invention is 0.5% by mass or more but less than 10% by mass, and more preferably 1% by mass or more but less than 6% by mass with respect to the total mass of the ink. In a case where two or more types of gelling agents are contained in the active ray-curable inkjet ink, the total amount of the gelling agents is preferably within the above-described range.

When the content of the gelling agent is less than 0.5% by mass, there is possibility that the active ray-curable inkjet ink may have insufficient sol-gel phase transition. On the other hand, when the content of the gelling agent is more than 10% by mass, the solubility of the gelling agent becomes unstable, and the ink ejection is likely to become unstable.

The gelling agent contained in the active ray-curable inkjet ink may be any one of wax and a hydrogen-bonding gelling agent, but from the viewpoint of making the viscosity be 5000 mPa·s or more and having sol-gel phase transition, wax or a hydrogen-bonding gelling agent is preferable, and particularly, from the viewpoint of compatibility with the photopolymerizable compound, wax having a polar group in the molecule is preferable.

(Wax)

The term "wax" in the invention indicates an organic material which is solid at normal temperature and becomes liquid when being heated. The melting point of the wax is preferably 30° C. or higher but lower than 150° C. The wax contained in the active ray-curable inkjet ink satisfies at least the following requirements: 1) the wax is dissolved in the photopolymerizable compound at a temperature higher than the gelation temperature; and 2) the wax is crystallized in the ink at a temperature equal to or lower than the gelation temperature.

When the wax is crystallized in the ink, it is preferable that a space three-dimensionally surrounded by plate-like crystals, which is a crystallization product of the wax, be formed so that the photopolymerizable compound is included in the space. As described above, a structure in which a photopolymerizable compound is included in a space three-dimensionally surrounded by plate-like crystals may be referred to as a "card house structure" in some cases. When the card house structure is formed, the liquid photopolymerizable compound can be maintained and ink droplets can be pinned. According to this, combining of liquid droplets can be suppressed. In order to form the card house structure, it is preferable that the photopolymerizable compound and the wax be compatible with each other. In contrast to this, when the phase separation between the photopolymerizable compound and the wax occurs, the card house structure may be difficult to be formed in some cases.

The type of the wax is not particularly limited. Preferred examples of the wax include aliphatic ketone compounds such as dibehenyl ketone, distearyl ketone, dipalmityl ketone, dimyristyl ketone, dilauryl ketone, palmityl stearyl ketone, stearyl behenyl ketone, 18-Pentatriacontanon (for example, reagent manufactured by Alfa Aeser), and ketone wax (for example, KAOWAX T1 manufactured by Kao Corporation); aliphatic monoester compounds such as behenyl behenate (for example, UNISTER M-2222SL manufactured by NOF CORPORATION), stearyl stearate (for example, EXCEPARL SS manufactured by Kao Corporation), cetyl palmitate (for example, AMREPS PC manufactured by KOKYU ALCOHOL KOGYO CO., LTD.), palmityl stearate, myristyl myristate, lauryl laurate, myricyl cerotinate, and behenyl montanate; petroleum waxes such as paraffin wax, microcrystalline wax, and petrolatum; vegetable waxes such as candelilla wax, carnauba wax, rice wax, wood wax, jojoba oil, jojoba solid wax, and jojoba ester; animal waxes such as beeswax, lanolin, and whale wax; mineral waxes such as montan wax and hydrogenated wax; a hydrogenated castor oil or a hydrogenated castor oil derivative; modified waxes such as a montan wax derivative, a paraffin wax derivative, a microcrystalline wax derivative, or a polyethylene wax derivative; higher fatty acids such as behenic acid, arachidic acid, stearic acid, palmitic acid, myristic acid, lauric acid, oleic acid, and erucic acid; higher alcohols such as stearyl alcohol and behenyl alcohol; hydroxystearic acids such as 12-hydroxystearic acid; 12-hydroxystearic acid derivatives; fatty acid amides such as lauric acid amide, stearic acid amide, behenic acid amide, oleic acid amide, erucic acid amide, ricinoleic acid amide, and 12-hydroxystearic acid amide (for example, NIKKA amide series manufactured by Nippon Kasei Chemical Co., Ltd., ITOHWAX series manufactured by Itoh Oil Chemicals Co., Ltd., and FATTYAMID series manufactured by Kao Corporation); N-substituted fatty acid amides such as N-stearyl stearic acid amide and N-oleyl palmitic acid amide; special fatty acid amides such as N,N'-ethylene bisstearyl amide, N,N'-ethylene bis-12-hydroxystearyl amide, and N,N'-xylylene bisstearyl amide; higher amines such as dodecyl amine, tetradecyl amine, or octadecyl amine; polyhydric alcohol fatty acid esters such as glycerin fatty acid ester, sorbitan fatty acid ester, propylene glycol fatty acid ester, ethylene glycol fatty acid ester, and polyoxyethylene fatty acid ester (for example, EMALLEX series manufactured by Nihon Emulsion Co., Ltd., RIKEMAL series manufactured by Riken Vitamin Co., Ltd., and POEM series manufactured by Riken Vitamin Co., Ltd.); sucrose fatty acid esters such as sucrose stearate and sucrose palmitate (for example, RYOTO sugar ester series manufactured by Mitsubishi-Kagaku Foods Corporation); synthetic waxes such as polyethylene wax and α-olefin maleic anhydride copolymer wax (for example, UNILIN series manufactured by Baker-Petrolite); dimer acids; and dimer diols (PRIPOR series manufactured by CRODA Inc., and the like).

Only one or two or more types of these waxes may be contained in the active ray-curable inkjet ink. In addition, a commercially available wax may be a mixture of two or more types of waxes in many cases. For this reason, the commercially available wax may be separated and purified for use as necessary.

As described above, the wax preferably has a polar group in the molecule. The polar group is preferably a ketone group, an —OH group, a carboxyl group, an amide group, a carbonyl group, an ester bond, or the like. In particular, the wax is preferably any of an aliphatic ketone compound, an aliphatic monoester compound, a higher fatty acid, a fatty acid amide, a higher alcohol, and a polyhydric alcohol fatty acid ester, and is more preferably an aliphatic ketone compound or an aliphatic monoester compound. In the wax in which a proton is included in the polar group, the polar group forms a hydrogen bond together with an acrylamide group and the solubility of the wax is excessively increased in some cases. For this reason, in the ink droplets landed on the recording medium, the precipitation of the gelling agent is inhibited and the sol-gel phase transition does not sufficiently occur in some cases. On the other hand, regarding the wax having a ketone group or an ester group (an aliphatic ketone compound or an aliphatic monoester compound), in the ink droplets landed on the recording medium, the gelling agent is easily precipitated and the sol-gel phase transition is sufficiently performed.

(Hydrogen-Bonding Gelling Agent)

The gelling agent may be a hydrogen-bonding gelling agent. The term "hydrogen-bonding gelling agent" in the invention indicates a compound which undergoes gelation by forming a metastable fibrous structure in the ink by intermolecular hydrogen bonding and in which a solvent is included in the network of the fiber structure.

Examples of the hydrogen-bonding gelling agent include fatty acid inulins such as stearic acid inulin; fatty acid dextrins such as dextrin palmitate and dextrin myristate (RHEOPEARL series manufactured by Chiba Flour Milling Co., Ltd.); glyceryl behenate eicosanedioate; polyglyceryl eicosane behenate (NOMCORT series manufactured by The Nisshin OilliO Group, Ltd.); amide compounds such as N-lauroyl-L-glutamic acid dibutyl amide and N-(2-ethylhexanoyl)-L-glutamic acid dibutyl amide (available from Ajinomoto Fine-Techno Co., Inc.); dibenzylidene sorbitols such as 1,3:2,4-bis-O-benzylidene-D-glucitol (GEL ALL D available from New Japan Chemical Co., Ltd.); and low molecular oil gelling agents described in JP 2005-126507 A, JP 2005-255821 A, and JP 2010-111790 A.

(Photopolymerization Initiator)

A photopolymerization initiator is further contained in the active ray-curable inkjet ink.

The photopolymerization initiator includes an intramolecular bond cleaving type and an intramolecular hydrogen withdrawing type. Examples of the intramolecular bond cleaving type photopolymerization initiator include acetophenones such as diethoxy acetophenone, 2-hydroxy-2-methyl-1-phenyl propane-1-one, benzyl dimethyl ketal, 1-(4-isopropyl phenyl)-2-hydroxy-2-methyl propane-1-one, 4-(2-hydroxyethoxy)phenyl-(2-hydroxy-2-propyl)ketone, 1-hydroxycyclohexyl-phenyl ketone, 2-methyl-2-morpholino(4-thio methylphenyl)propane-1-one, and 2-benzyl-2-dimethylamino-1-(4-morpholinophenyl)-butanone; benzoins such as benzoin, benzoin methyl ether, and benzoin isopropyl ether; acyl phosphine oxides such as 2,4,6-trimethyl benzoin diphenyl phosphine oxide; benzyl, and methylphenyl glyoxy ester.

Examples of the intramolecular hydrogen withdrawing type photopolymerization initiator include benzophenones such as benzophenone, o-benzoyl benzoic acid methyl-4-phenylbenzophenone, 4,4'-dichloro benzophenone, hydroxybenzophenone, 4-benzoyl-4'-methyl-diphenyl sulfide, acrylated benzophenone, 3,3',4,4'-tetra(t-butyl peroxy carbonyl)benzophenone, and 3,3'-dimethyl-4-methoxybenzophenone; thioxanthones such as 2-isopropyl thioxanthone, 2,4-dimethyl thioxanthone, 2,4-diethyl thioxanthone, and 2,4-dichloro thioxanthone; aminobenzophenones such as Michler's ketone and 4,4'-diethylaminobenzophenone; 10-butyl-2-chloro acridone, 2-ethyl anthraquinone, 9,10-phenanthrene quinone, and camphor quinone.

The content of the photopolymerization initiator in the active ray-curable inkjet ink is preferably 0.01% by mass to 10% by mass although the content varies depending on the types of the active ray or the photopolymerizable compounds.

A photoacid generating agent may be contained in the photopolymerization initiator in the active ray-curable inkjet ink. As an example of the photoacid generating agent, a compound used for chemical amplification type photoresists or photo-cationic polymerization is used (see Pages 187 to 192 of "Imaging Yo Yuki Zairyo (Organic Materials Used for Imaging Applications)" edited by The Japanese Research Association for Organic Electronics Materials published by Bunshin Publishing (1993)).

A photopolymerization initiator auxiliary agent, a polymerization inhibitor, or the like may be contained in the active ray-curable inkjet ink as necessary. The photopolymerization initiator auxiliary agent may be a tertiary amine compound and is preferably an aromatic tertiary amine compound. Examples of the aromatic tertiary amine compound include N,N-dimethylaniline, N,N-diethylaniline, N,N-dimethyl-p-toluidine, N,N-dimethylamino-p-benzoic acid ethyl ester, N,N-dimethylamino-p-benzoic acid isoamyl ethyl ester, N,N-dihydroxy ethylaniline, triethylamine, and N,N-dimethyl hexylamine. Among them, N,N-dimethylamino-p-benzoic acid ethyl ester, and N,N-dimethylamino-p-benzoic acid isoamyl ethyl ester are preferable. Only one or two or more types of these compounds may be contained in the active ray-curable inkjet ink.

Examples of the polymerization inhibitor include (alkyl) phenol, hydroquinone, catechol, resorcin, p-methoxyphenol, t-butyl catechol, t-butyl hydroquinone, pyrogallol, 1,1-picrylhydrazyl, phenothiazine, p-benzoquinone, nitrosobenzene, 2,5-di-t-butyl-p-benzoquinone, dithiobenzoyl disulfide, picric acid, cupferrone, aluminum N-nitrosophenyl hydroxylamine, tri-p-nitrophenylmethyl, N-(3-oxyanilino-1,3-dimethylbutylidene)aniline oxide, dibutyl cresol, cyclohexanone oxime cresol, guaiacol, o-isopropylphenol, butyraldoxime, methyl ethyl ketoxime, and cyclohexanone oxime.

(Colorant)

A colorant may be contained in the active ray-curable inkjet ink. The colorant may be a dye or a pigment. A pigment is more preferably from the viewpoint of having favorable dispersibility in a constituent of the ink and excellent weather resistance.

The dye may be an oil-soluble dye or the like. Examples of the oil-soluble dye include the following various dyes. Examples of a magenta dye include MS Magenta VP, MS Magenta HM-1450, and MS Magenta HSo-147 (all manufactured by Mitsui-Toatsu Chemicals), AIZENSOT Red-1, AIZEN SOT Red-2, AIZEN SOTRed-3, AIZEN SOT Pink-1, and SPIRON Red GEH SPECIAL (all manufactured by Hodogaya Chemical Co., Ltd.), RESOLIN Red FB 200%, MACROLEX Red Violet R, and MACROLEX ROT5B (all manufactured by Bayer Japan), KAYASET Red B, KAYASET Red 130, and KAYASET Red 802 (all manufactured by Nippon Kayaku Co., Ltd.), PHLOXIN, ROSE BENGAL, and ACID Red (all manufactured by Daiwa Kasei Industry Co., Ltd.), HSR-31 and DIARESIN Red K (all manufactured by Mitsubishi Chemical Corporation), and Oil Red (manufactured by BASF Japan).

Examples of a cyan dye include MS Cyan HM-1238, MS Cyan HSo-16, Cyan HSo-144, and MS Cyan VPG (all manufactured by Mitsui-Toatsu Chemicals), AIZEN SOT Blue-4 (manufactured by Hodogaya Chemical Co., Ltd.), RESOLIN BR. Blue BGLN 200%, MACROLEX Blue RR, CERES Blue GN, SIRIUS SUPRATURQ. Blue Z-BGL, and SIRIUS SUPRA TURQ. Blue FB-LL 330% (all manufactured by Bayer Japan), KAYASET Blue FR, KAYASET Blue N, KAYASET Blue 814, Turq. Blue GL-5 200, and Light Blue BGL-5 200 (all manufactured by Nippon Kayaku Co., Ltd.), DAIWA Blue 7000 and Oleosol Fast Blue GL (all manufactured by Daiwa Kasei Industry Co., Ltd.), DIARESIN Blue P (manufactured by Mitsubishi Chemical Corporation), and SUDAN Blue 670, NEOPEN Blue 808, and ZAPON Blue 806 (all manufactured by BASF Japan).

Examples of a yellow dye include MS Yellow HSm-41, Yellow KX-7, and Yellow EX-27 (manufactured by Mitsui-Toatsu Chemicals), AIZEN SOT Yellow-1, AIZEN SOT YelloW-3, and AIZEN SOT Yellow-6 (all manufactured by Hodogaya Chemical Co., Ltd.), MACROLEX Yellow 6G and MACROLEX FLUOR. Yellow 10GN (all manufactured by Bayer Japan), KAYASET Yellow SF-G, KAYASET Yellow2G, KAYASET Yellow A-G, and KAYASET Yellow E-G (all manufactured by Nippon Kayaku Co., Ltd.), DAIWA Yellow 330HB (manufactured by Daiwa Kasei Industry Co., Ltd.), HSY-68 (manufactured by Mitsubishi Chemical Corporation), and SUDAN Yellow 146 and NEOPEN Yellow 075 (all manufactured by BASF Japan).

Examples of a black dye include MS Black VPC (manufactured by Mitsui-Toatsu Chemicals), AIZEN SOT Black-1 and AIZEN SOT Black-5 (all manufactured by Hodogaya Chemical Co., Ltd.), RESORIN Black GSN 200% and RESOLIN BlackBS (all manufactured by Bayer Japan), KAYASET Black A-N (manufactured by Nippon Kayaku Co., Ltd.), DAIWA Black MSC (manufactured by Daiwa Kasei Industry Co., Ltd.), HSB-202 (manufactured by Mitsubishi Chemical Corporation), and NEPTUNE Black X60 and NEOPEN Black X58 (all manufactured by BASF Japan).

The pigment is not particularly limited, but may be, for example, an organic pigment or an inorganic pigment with a color index number in the following.

Examples of a red or magenta pigment include Pigment Red 3, 5, 19, 22, 31, 38, 43, 48:1, 48:2, 48:3, 48:4, 48:5, 49:1, 53:1, 57:1, 57:2, 58:4, 63:1, 81, 81:1, 81:2, 81:3, 81:4, 88, 104, 108, 112, 122, 123, 144, 146, 149, 166, 168, 169, 170, 177, 178, 179, 184, 185, 208, 216, 226, or 257, Pigment Violet 3, 19, 23, 29, 30, 37, 50, or 88, and Pigment Orange 13, 16, 20, or 36. Examples of a blue or cyan pigment include Pigment Blue 1, 15, 15:1, 15:2, 15:3, 15:4, 15:6, 16, 17-1, 22, 27, 28, 29, 36, or 60. Examples of a green pigment include Pigment Green 7, 26, 36, or 50. Examples of a yellow pigment include Pigment Yellow 1, 3, 12, 13, 14, 17, 34, 35, 37, 55, 74, 81, 83, 93, 94, 95, 97, 108, 109, 110, 137, 138, 139, 153, 154, 155, 157, 166, 167, 168, 180, 185, or 193. Examples of a black pigment include Pigment Black 7, 28, or 26.

Examples of a commercially available pigment include Chromo Fine Yellow 2080, 5900, 5930, AF-1300, or 2700L, Chromo Fine Orange 3700L or 6730, Chromo Fine Scarlet 6750, Chromo Fine Magenta 6880, 6886, 6891N, 6790, or 6887, Chromo Fine Violet RE, Chromo Fine Red 6820 or 6830, Chromo Fine Blue HS-3, 5187, 5108, 5197, 5085N, SR-5020, 5026, 5050, 4920, 4927, 4937, 4824, 4933GN-EP, 4940, 4973, 5205, 5208, 5214, 5221, or 5000P, Chromo Fine Green 2GN, 2GO, 2G-550D, 5310, 5370, or 6830, Chromo Fine Black A-1103, Seikafast Yellow 10GH, A-3, 2035, 2054, 2200, 2270, 2300, 2400(B), 2500, 2600, ZAY-260, 2700(B), or 2770, Seikafast Red 8040, C405(F), CA120, LR-116, 1531B, 8060R, 1547, ZAW-262, 1537B, GY, 4R-4016, 3820, 3891, or ZA-215, Seikafast Carmine 6B1476T-7, 1483LT, 3840, or 3870, Seikafast Bordeaux 10B-430, Seikalight Rose R40, Seikalight Violet B800 or 7805, Seikafast Maroon 460N, Seikafast Orange 900 or 2900, Seikalight Blue C718 or A612, and Cyanine Blue 4933M, 4933GN-EP, 4940, or 4973 (manufactured by Dainichiseika Color & Chemicals Mfg. Co., Ltd.);

KET Yellow 401, 402, 403, 404, 405, 406, 416, or 424, KET Orange 501, KET Red 301, 302, 303, 304, 305, 306, 307, 308, 309, 310, 336, 337, 338, or 346, KET Blue 101, 102, 103, 104, 105, 106, 111, 118, or 124, and KET Green 201 (manufactured by DIC Corporation);

Colortex Yellow 301, 314, 315, 316, P-624, 314, U10GN, U3GN, UNN, UA-414, or U263, Finecol Yellow T-13 or T-05, Pigment Yellow 1705, Colortex Orange 202, Colortex Red 101, 103, 115, 116, D3B, P-625, 102, H-1024, 105C, UFN, UCN, UBN, U3BN, URN, UGN, UG276, U456, U457, or 105C, USN, Colortex Maroon 601, Colortex Brown B610N, Colortex Violet 600, Pigment Red 122, Colortex Blue 516, 517, 518, 519, A818, P-908, or 510, Colortex Green 402 or 403, and Colortex Black 702 or U905 (manufactured by SANYO COLOR WORKS, Ltd.);

Lionol Yellow 1405G, and Lionol Blue FG7330, FG7350, FG7400G, FG7405G, ES, or ESP-S (manufactured by TOYO INK CO., LTD.), Toner Magenta E02, Permanent Rubin F6B, Toner Yellow HG, Permanent Yellow GG-02, and Hostapeam Blue B2G (manufactured by Hoechst Industry Ltd.);

Novoperm P-HG, Hostaperm Pink E, and Hostaperm Blue B2G (manufactured by Clariant (Japan) K.K.); and Carbon Black #2600, #2400, #2350, #2200, #1000, #990, #980, #970, #960, #950, #850, MCF88, #750, #650, MA600, MA7, MA8, MA11, MA100, MA100R, MA77,

#52, #50, #47, #45, #45L, #40, #33, #32, #30, #25, #20, #10, #5, #44, or CF9 (manufactured by Mitsubishi Chemical Corporation).

The dispersion of the pigment can be performed using a ball mill, a sand mill, an attritor, a roll mill, an agitator, a Henschel mixer, a colloid mill, an ultrasound homogenizer, a pearl mill, a wet jet mill, or a paint shaker, for example. The dispersion of the pigment is preferably performed such that the pigment particles have an average particle diameter of 0.08 to 0.5 μm, a maximum particle diameter of 0.3 to 10 μm, and more preferably 0.3 to 3 μm. The dispersion of the pigment is adjusted by selections of a pigment, a dispersant, and a dispersion medium, dispersing conditions, filtering conditions, and the like.

A dispersant may be further contained in the active ray-curable inkjet ink in order to enhance the dispersibility of the pigment. Examples of the dispersant include hydroxyl group-containing carboxylic acid esters, salts of long-chain polyaminoamides and high molecular weight acid esters, salts of high molecular weight polycarboxylic acids, salts of long-chain polyaminoamides and polar acid esters, high molecular weight unsaturated acid esters, high molecular weight copolymers, modified polyurethanes, modified polyacrylates, polyether ester-type anionic active agents, naphthalenesulfonic acid formalin condensate salts, aromatic sulfonic acid formalin condensate salts, polyoxyethylene alkyl phosphoric acid esters, polyoxyethylene nonyl phenyl ethers, and stearylamine acetates. Examples of commercially available dispersants include Solsperse series from Avecia Biotechnology, Inc. and PB series from Ajinomoto Fine-Techno Co., Inc.

A dispersion promoter may be further contained in the active ray-curable inkjet ink as necessary. The dispersion promoter may be selected according to the type of the pigment.

The total amount of the dispersant and the dispersion promoter is preferably 1 to 50% by mass with respect to the pigment.

The pigment may be dispersed in a solvent or the like, but it is preferable that the pigment be dispersed in the above-described photopolymerizable compound (particularly, a monomer having a low viscosity).

The content of the pigment or the dye is preferably 0.1 to 20% by mass and more preferably 0.4 to 10% by mass with respect to the total mass of the active ray-curable inkjet ink. The reason for this is that, when the content of the pigment or the dye is too small, color exhibition of an image to be obtained is not sufficient, and when the content of the pigment or the dye is too large, the viscosity of the ink is increased and the ejectability of the ink from the inkjet printer is decreased.

(Other Components)

Other components may be further contained in the active ray-curable inkjet ink as necessary. The other components may be various additives and other resins. Examples of the additives include surfactants, leveling agents, matting agents, UV absorbers, IR absorbers, antibacterial agents, and basic compounds for increasing the storage stability of the ink. Examples of the basic compounds include basic alkali metal compounds, basic alkali earth metal compounds, and basic organic compounds such as amines. Examples of the other resins include resins for adjusting the physical properties of a cured film, and examples thereof include polyester resins, polyurethane resins, vinyl resins, acrylic resins, rubber resins, and waxes.

(Organic Solvent)

Water or an organic solvent may be contained in the active ray-curable inkjet ink as necessary. When the organic solvent is contained in the ink, an effect that the ink is easily impregnated into the recording medium, or the like is obtained.

Examples of the organic solvent include alkanediols (polyalcohols) such as glycerin, 1,2,6-hexanetriol, trimethylolpropane, ethylene glycol, propylene glycol, 1,3-butanediol, 2,3-butanediol, 2-ethyl-2-methyl-1,3-propanediol, 3,3-dimethyl-1,2-butanediol, 2,2-diethyl-1,3-propanediol, 2-ethyl-1,3-hexanediol, and 2,2,4-trimethyl-1,3-pentanediol; sugar alcohols; alkyl alcohols having 1 to 4 carbon atoms such as ethanol, methanol, butanol, propanol, and isopropanol; and glycol ethers such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, triethylene glycol monoethyl ether, 1-methyl-1-methoxybutanol, propylene glycol monomethyl ether, propylene glycol monoethyl ether, propylene glycol mono-t-butyl ether, propylene glycol mono-n-propyl ether, propylene glycol mono-iso-propyl ether, dipropylene glycol, dipropylene glycol monomethyl ether, dipropylene glycol monoethyl ether, dipropylene glycol mono-n-propyl ether, dipropylene glycol mono-iso-propyl ether, and tripropylene glycol monomethyl ether. These can be used alone or in combination of two or more thereof.

(Physical Properties of Active Ray-Curable Inkjet Ink)

The active ray-curable inkjet ink is an ink that undergoes temperature-induced reversible sol-gel phase transition as described above. The sol-gel phase transition type active ray-curable ink is in a sol state at a high temperature (for example, about 80° C.), so that the ink can be ejected from the inkjet recording head. When the active ray-curable inkjet ink is ejected at a high temperature, ink droplets (dots) are landed on the recording medium and then undergo gelation by natural cooling. Consequently, combining of adjacent dots is suppressed and thus the image quality can be improved.

In order to improve the ejectability of the sol-gel phase transition type ink, the viscosity of the ink at a high temperature is preferably equal to or lower than a certain value. Specifically, the viscosity at 80° C. of the active ray-curable inkjet ink is preferably 3 to 20 mPa·s. On the other hand, in order to suppress the combining of adjacent dots, the viscosity of the ink at normal temperature after landing is preferably equal to or higher than a certain value. Specifically, the viscosity at 25° C. of the active ray-curable inkjet ink after shearing is preferably 1000 mPa·s or more.

The gelation temperature of the sol-gel phase transition type ink is preferably 40° C. or higher but 70° C. or lower, and more preferably 50° C. or higher but 65° C. or lower. In a case where the ejection temperature of the ink is near 80° C., when the gelation temperature of the ink is higher than 70° C., gelation is likely to occur at the time of ejection and ejectability is decreased. On the other hand, when the gelation temperature is lower than 40° C., the ink after landed on the recording medium is difficult to undergo quick gelation. The gelation temperature indicates a temperature when fluidity is lowered by gelation of the ink in a sol state in a process of cooling the sol-state ink.

As the rheometer, stress control type rheometer Physica MCR series manufactured by Anton Paar GmbH can be used. The diameter of the corn plate can be set to 75 mm, and the corn angle can be set to 1.0°.

(Method for Preparing Active Ray-Curable Inkjet Ink)

The active ray-curable inkjet ink can be obtained by mixing the photopolymerizable compound, the gelling agent, the photopolymerization initiator, the colorant, and each optional component under heating conditions. The obtained mixed liquid is preferably filtrated with a predetermined filter.

[Image Formation Method]

The image formation method is not particularly limited, but preferably includes (a) a step of preparing the inkjet printer 1 as illustrated in FIG. 1 and the active ray-curable inkjet ink as described above, (b) a step of shearing the ink, (c) a step of supplying the sheared ink to the ink head while the sheared ink is heated, (d) a step of ejecting the active ray-curable inkjet ink to a recording medium, and (e) a step of curing the ink by irradiating the ink landed on the recording medium with an active ray.

As for Step (a)

Regarding the supplying of the ink to the ink storage unit, the ink may be supplied from a conveyance container to the ink storage unit or may be conveyed or replaced for each ink storage unit. The ink to be supplied to the ink storage unit is not particularly limited, but even when the ink having a viscosity of 5000 mPa·s or more is supplied, according to the method of the invention, it is easy to send the liquid and it is possible to form an image with small unevenness in density and glossiness.

As for Step (b)

The shearing method is not particularly limited, but the shearing can be performed by using a method of rotating the rotating blade in the ink, a method using a static mixer, or the like. However, from the viewpoint that a large amount of the ink can be sheared in a short time and the configuration of a device used for shearing can be simplified, it is preferable that the ink be sheared by the rotating blade.

In a case where the ink is sheared by the rotating blade, the rotation speed of the rotating blade is not particularly limited, but it is preferable that the ink be sheared under the condition that the circumferential velocity of the rotating blade is 100 rpm to 600 rpm.

The shearing preferably decreases the viscosity of the ink after shearing to at least ⅕ or less of the viscosity of the ink before shearing.

As for Step (c)

It is preferable that the ink supply unit and the ink heating unit be operated and the sheared ink be supplied to the ink head while the sheared ink is heated. The supply speed is not particularly limited as long as it is more than the ejection amount of the ink. In addition, the ink is preferably heated such that the viscosity of the ink is within the range of 5 mPa·s or more to 30 mPa·s or less. In order to set the viscosity of the ink to be within the range of 5 mPa·s or more to 30 mPa·s or less, for example, the ink may be heated to a temperature equal to or higher than the gelation temperature of the ink+10° C.

As for Step (d)

The active ray-curable inkjet ink accommodated in the inkjet recording head is ejected as droplets toward a recording medium through a nozzle. At this time, the temperature of the inkjet ink accommodated in the inkjet recording head is set to a temperature at which the gelling agent is not precipitated. That is, the temperature of the inkjet ink accommodated in the inkjet recording head is set to a temperature at which the saturated dissolution amount of the gelling agent with respect to the ink is larger than the amount of the gelling agent contained in the ink.

In order to improve the ejectability of the ink droplets, the temperature of the inkjet ink inside the inkjet recording head is preferably set to a temperature higher than the gelation temperature by 10 to 30° C. When the ink temperature inside the inkjet recording head is lower than (the gelation temperature+10)° C., the gelation of the ink occurs in the inkjet recording head or on the surface of the nozzle, and thus the ejectability of the ink droplets is likely to decrease. On the other hand, when the temperature of the ink inside the inkjet recording head is higher than (the gelation temperature+30)° C., the temperature of the ink is too high, and thus the ink components may deteriorate in some cases.

It is preferable that the inkjet ink in the inkjet recording head, the ink channel connected to the inkjet recording head, or the ink tank connected to the ink channel be heated and then the inkjet ink droplets with a predetermined temperature be ejected.

The ink droplets landed on the recording medium are cooled and undergo gelation rapidly by sol-gel phase transition. According to this, the ink droplets can be pinned while the ink droplets are not diffused. Furthermore, oxygen is less likely to be diffused in the ink droplets. For this reason, in Step (e) to be described later, the photopolymerization of the photopolymerizable compound is less likely to be inhibited by oxygen, the curability of the ink is increased, and thus the ink can be sufficiently cured even by a light source with a low light quantity such as an LED.

The temperature of the recording medium when the ink droplets are landed is preferably set to a temperature lower than the gelation temperature of the ink by 10 to 20° C. When the temperature of the recording medium is too low, the ink droplets undergo gelation and are pinned too fast so that leveling of the ink droplets does not occur sufficiently, and as a result, the glossiness of an image may be lowered. On the other hand, when the temperature of the recording medium is too high, it is difficult for the ink droplets to undergo gelation, and thus adjacent dots may be mixed with each other. By appropriately adjusting the temperature of the recording medium, it is possible to achieve both a moderate level of leveling and appropriate pinning that do not allow for mixing among adjacent dots of the ink droplets.

The recording medium may be paper or a resin film. Examples of paper include coated paper for printing and coated paper for printing B. Further, examples of the resin film include a polyethylene terephthalate film and a vinyl chloride film.

The conveyance speed of the recording medium is preferably 30 to 120 m/min. As the conveyance speed increases, the image forming speed also increases, which is desirable. However, when the conveyance speed is too fast, the image quality is degraded or the curing of the ink is not sufficient.

As for Step (e)

By irradiating the ink landed on the recording medium with an active ray, the photopolymerizable compounds contained in the ink droplets are crosslinked or polymerized to cure the ink droplets.

The active ray to be radiated may be appropriately selected depending on the type of the photopolymerizable compound and may be a UV ray or an electron beam. As a light source of the UV ray, a metal halide lamp or the like may be used, but when an LED is used as a light source, it is possible to prevent the surfaces of the ink droplets from being melted by radiation heat of the light source.

Light from the LED light source preferably has a peak illuminance of 1.0 to 10.0 W/cm$^2$ at the wavelength of 370 to 410 nm, and more preferably a peak illuminance of 1.0 to 5.0 W/cm$^2$. The peak illuminance is an illuminance on the surface of the recording medium. In addition, the conveyance speed of the recording medium at the time of light irradiation is preferably 30 to 120 m/min. As the conveyance speed increases, the influence of radiation heat is decreased and the image forming speed also increases, which is desirable. However, when the conveyance speed is too fast, there is a concern that the photocuring is not sufficient.

At the time of irradiation with the active ray, the temperature of the recording medium can be adjusted arbitrarily. The temperature of the recording medium in the ejecting step and the temperature of the recording medium in the curing step are not necessarily the same as each other, and may be independently controlled.

EXAMPLES

Hereinafter, the invention will be described in more detail with reference to Examples, but it is not understood that the scope of the invention is limited to the description of Examples.

Furthermore, the viscosity in the following Examples is a value measured by using stress control type rheometer Physica MCR series manufactured by Anton Paar GmbH when a diameter of a corn plate is set to 75 mm and a corn angle is set to 1.0°.

Example 1

An active ray-curable inkjet ink was prepared by using components (a photopolymerizable compound, a gelling agent, a photopolymerization initiator, a polymerization inhibitor, and a pigment dispersion) and a blended amount as presented in Table 1.

(Photopolymerizable Compound)

Polymerizable Compound A

N-(2-hydroxyethyl)acrylamide (manufactured by Tokyo Chemical Industry Co., Ltd., molecular weight: 115, C log P value: −1.03)

N,N'-(1,2-dihydroxyethylene)bisacrylamide (manufactured by Tokyo Chemical Industry Co., Ltd., molecular weight: 200, C log P value: −3.00)

Polymerizable Compound B

Polyethylene glycol diacrylate (NK Ester A-400, manufactured by Shin Nakamura Chemical Co., Ltd., molecular weight: 508, amount of EO unit: 9, C log P value: 0.47)

6EO modified trimethylolpropane triacrylate (SR499, manufactured by Sartomer, molecular weight: 560, C log P value: 3.57)

Other Polymerizable Compound

3PO modified trimethylolpropane triacrylate (Photomer 4072, manufactured by Cognis, molecular weight: 471, C log P value: 4.90)

(Gelling Agent)

Wax

Behenic acid (LUNAC BA, manufactured by Kao Corporation, molecular weight: 340, C log P value: 10.1)

Palmitic acid amide (Diamid KP, manufactured by Nippon Kasei Chemical Co., Ltd., molecular weight: 255, C log P value: 6.3)

Aliphatic ketone (KAOWAX T1, manufactured by Kao Corporation, C log P value: 15 or more)

Behenyl behenate (UNISTER M-2222SL, manufactured by NOF CORPORATION, C log P value: 15 or more)

Gelling agent represented by the following General Formula (12) (Unilin 425, manufactured by Baker-Petrolite)

TABLE 1

| | | | Sample 1 | Sample 2 | Sample 3 | Sample 4 | Sample 5 | Sample 6 |
|---|---|---|---|---|---|---|---|---|
| Composition | Gelling agent | Behenic acid | 5.0% | | | | | |
| | | Palmitic acid amide | | 5.0% | | | | |
| | | Aliphatic ketone | | | 5.0% | | | |
| | | Behenyl behenate | | | | 5.0% | | |
| | | General Formula (12) | | | | | 5.0% | |
| | | General Formula (13) | | | | | | 5.0% |
| | Polymerizable compound A | N-(2-hydroxyethyl)acrylamide | 6.0% | 6.0% | 6.0% | 6.0% | 6.0% | 6.0% |
| | | N,N'-(1,2-dihydroxyethylene)bisacrylamide | 4.0% | 4.0% | 4.0% | 4.0% | 4.0% | 4.0% |
| | Polymerizable compound B | Polyethylene glycol #400 diacrylate | 20.0% | 20.0% | 20.0% | 20.0% | 20.0% | 20.0% |
| | | 6EO modified trimethylolpropane triacrylate | 29.5% | 29.5% | 29.5% | 29.5% | 29.5% | 29.5% |
| | Other polymerizable compound | 3PO modified trimethylolpropane triacrylate | 15.9% | 15.9% | 15.9% | 15.9% | 15.9% | 15.9% |
| | Polymerization inhibitor | UV10 | 0.1% | 0.1% | 0.1% | 0.1% | 0.1% | 0.1% |
| | Photopolymerization initiator | TPO | 5.0% | 5.0% | 5.0% | 5.0% | 5.0% | 5.0% |
| | Pigment Dispersion 1 | Tripropylene glycol diacrylate (polymerizable compound B) | 10.2% | 10.2% | 10.2% | 10.2% | 10.2% | 10.2% |
| | | Dispersant PB824 | 1.3% | 1.3% | 1.3% | 1.3% | 1.3% | 1.3% |
| | | Black pigment | 3.0% | 3.0% | 3.0% | 3.0% | 3.0% | 3.0% |
| | Total (% by mass) | | 100% | 100% | 100% | 100% | 100% | 100% |
| Viscosity (mPa · s) | | | $2.2 \times 10^5$ | $2.3 \times 10^5$ | $2.3 \times 10^5$ | $2.2 \times 10^5$ | $2.4 \times 10^5$ | $2.4 \times 10^5$ |

[Chemical Formula 12]

(12)

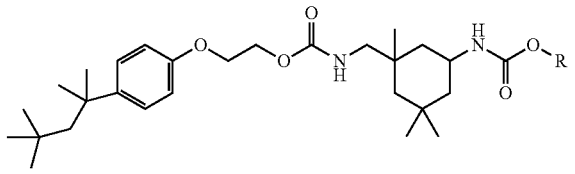

Gelling agent represented by the following General Formula (13)

[Chemical Formula 13]

(13)

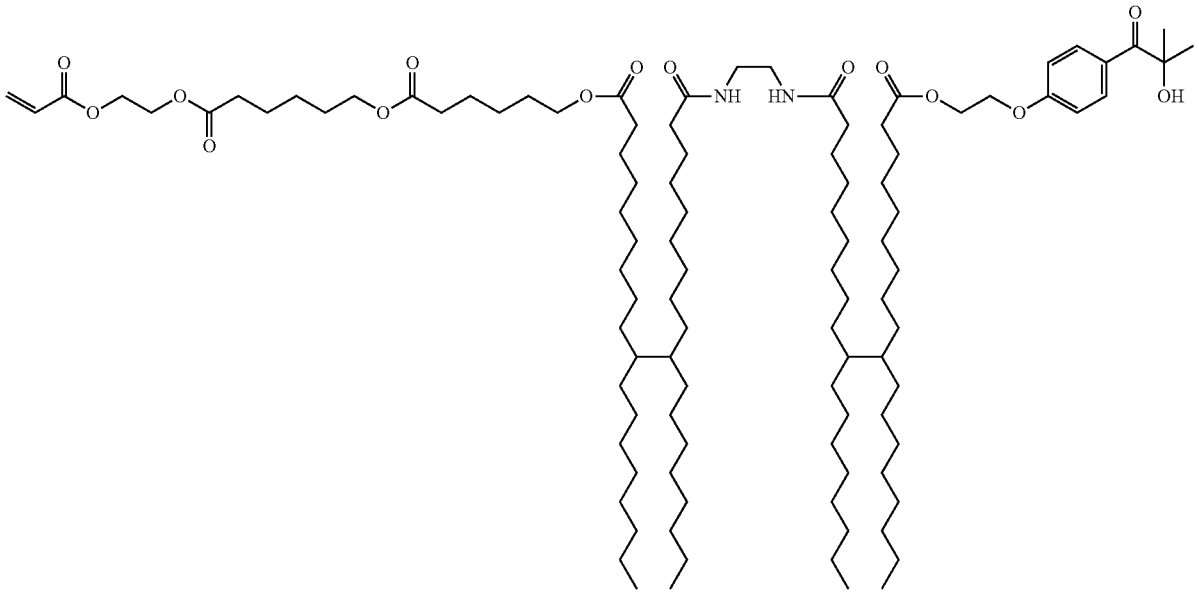

Incidentally, the gelling agent represented by the above General Formula (13) was synthesized by a method described in Paragraphs 0081 to 0084 of JP 2012-236998 A.

(Photopolymerization Initiator)

DAROCURE TPO (manufactured by Ciba Specialty Chemicals Inc.)

(Polymerization Inhibitor)

Irgastab UV10 (manufactured by Ciba Specialty Chemicals Inc.)

(Pigment Dispersion)

Preparation of Pigment Dispersion 1 (K: Black)

A dispersant, a photopolymerizable compound, and a polymerization inhibitor were put into a stainless steel beaker at composition ratios to be described below, and the mixture was stirred while heated on a hot plate at 65° C. for 1 hour so as to be dissolved. The obtained solution was cooled to room temperature, and then the following black pigment 1 was added thereto. The mixture was put and sealed together with 200 g of zirconia beads with a diameter of 0.5 mm into a glass bottle and subjected to dispersion treatment for 5 hours with a paint shaker. Thereafter, the zirconia beads were removed to prepare a pigment dispersion 1.

Composition of Pigment Dispersion 1

Dispersant: 9 Parts by Mass of AJISPER PB824 (Manufactured by Ajinomoto Fine-Techno Co., Inc.)

Photopolymerizable compound: 70 parts by mass of tripropylene glycol diacrylate (APG-200, manufactured by Shin Nakamura Chemical Co., Ltd., molecular weight: 300, C log P value: 2.21)

Polymerization inhibitor: 0.02 part by mass of Irgastab UV10 (manufactured by Ciba Specialty Chemicals Inc.)

Black Pigment 1: 21 Parts by Mass of Pigment Black 7 (Manufactured by Mitsubishi Chemical Corporation, #52)

[Preparation of Ink]

After respective components were mixed according to the compositions described in Table 1, the mixture was heated to 80° C. with stirring. The obtained solution was filtrated with a metal mesh filter #3000 under heated conditions, and then cooled to prepare the ink. In Table 1, the unit for the blended amount of each component is % by mass.

[Shearing Condition, Liquid Sending Condition, and Evaluation of Liquid Sending Property]

Each of the obtained Samples 1 to 6 (active ray-curable inkjet inks) was charged in a cylindrical ink tank (the ink storage unit) having a container inner diameter of 20 cm under the conditions presented in Tables 2 to 7, and was sheared with a rotating blade having a radius of 15 cm. The distance between the rotating blade and the container bottom was 1 cm, and the circumferential velocity of the rotating blade was 200 rpm. After shearing, the viscosity of the ink before heating was 300 mPa·s. The sheared ink was supplied to the ink head while heated to 80° C. The viscosity of the ink after heating was 8.5 mPa·s. The liquid sending property was evaluated based on the following criteria. The results thereof are presented in Tables 2 to 7.

In Tables 2 to 7, the section "Shearing device" indicates presence or absence of the shearing in the ink storage unit.

In Tables 2 to 7, the section "Shearing before charging" indicates presence or absence of the shearing performed under the same condition as in the ink storage unit when the ink was divided into small quantity after the production of the ink.

In Tables 2 to 7, the section "Shearing time" indicates time for which the ink was sheared in the ink storage unit.

(Evaluation of Liquid Sending Property)

The inside of the ink storage unit after sending the liquid was visually observed, and the evaluation was performed based on the following criteria.

○: The liquid can be sent with almost no ink residues.

x: There is a large amount of ink residues.

TABLE 2

| Sample 1 | Shearing device | Shearing at the time of charging | Shearing time | Liquid sending property | Image quality (unevenness in density) | Unevenness in glossiness | Remark |
|---|---|---|---|---|---|---|---|
| Experiment 1-1 | Absence | Absence | — | x | Δ | ○ | Comparative Example |
| Experiment 1-2 | Presence | Absence | 5 minutes | ○ | ○ | Δ | Example |
| Experiment 1-3 | Presence | Absence | 30 minutes | ○ | ○ | ○ | Example |
| Experiment 1-4 | Presence | Presence | 5 minutes | ○ | ○ | ○ | Example |
| Experiment 1-5 | Absence | Presence | — | x | x | x | Comparative Example |

TABLE 3

| Sample 2 | Shearing device | Shearing at the time of charging | Shearing time | Liquid sending property | Image quality (unevenness in density) | Unevenness in glossiness | Remark |
|---|---|---|---|---|---|---|---|
| Experiment 2-1 | Absence | Absence | — | x | Δ | ○ | Comparative Example |
| Experiment 2-2 | Presence | Absence | 5 minutes | ○ | ○ | Δ | Example |
| Experiment 2-3 | Presence | Absence | 30 minutes | ○ | ○ | ○ | Example |
| Experiment 2-4 | Presence | Presence | 5 minutes | ○ | ○ | ○ | Example |
| Experiment 2-5 | Absence | Presence | — | x | x | x | Comparative Example |

TABLE 4

| Sample 3 | Shearing device | Shearing at the time of charging | Shearing time | Liquid sending property | Image quality (unevenness in density) | Unevenness in glossiness | Remark |
|---|---|---|---|---|---|---|---|
| Experiment 3-1 | Absence | Absence | — | x | Δ | ○ | Comparative Example |
| Experiment 3-2 | Presence | Absence | 5 minutes | ○ | ○ | Δ | Example |
| Experiment 3-3 | Presence | Absence | 30 minutes | ○ | ○ | ○ | Example |
| Experiment 3-4 | Presence | Presence | 5 minutes | ○ | ○ | ○ | Example |
| Experiment 3-5 | Absence | Presence | — | x | x | x | Comparative Example |

TABLE 5

| Sample 4 | Shearing device | Shearing at the time of charging | Shearing time | Liquid sending property | Image quality (unevenness in density) | Unevenness in glossiness | Remark |
|---|---|---|---|---|---|---|---|
| Experiment 4-1 | Absence | Absence | — | x | Δ | ○ | Comparative Example |
| Experiment 4-2 | Presence | Absence | 5 minutes | ○ | ○ | Δ | Example |

TABLE 5-continued

| Sample 4 | Shearing device | Shearing at the time of charging | Shearing time | Liquid sending property | Image quality (unevenness in density) | Unevenness in glossiness | Remark |
|---|---|---|---|---|---|---|---|
| Experiment 4-3 | Presence | Absence | 30 minutes | ○ | ○ | ○ | Example |
| Experiment 4-4 | Presence | Presence | 5 minutes | ○ | ○ | ○ | Example |
| Experiment 4-5 | Absence | Presence | — | x | x | x | Comparative Example |

TABLE 6

| Sample 5 | Shearing device | Shearing at the time of charging | Shearing time | Liquid sending property | Image quality (unevenness in density) | Unevenness in glossiness | Remark |
|---|---|---|---|---|---|---|---|
| Experiment 5-1 | Absence | Absence | — | x | Δ | ○ | Comparative Example |
| Experiment 5-2 | Presence | Absence | 5 minutes | ○ | ○ | Δ | Example |
| Experiment 5-3 | Presence | Absence | 30 minutes | ○ | ○ | ○ | Example |
| Experiment 5-4 | Presence | Presence | 5 minutes | ○ | ○ | ○ | Example |
| Experiment 5-5 | Absence | Presence | — | x | x | x | Comparative Example |

TABLE 7

| Sample 6 | Shearing device | Shearing at the time of charging | Shearing time | Liquid sending property | Image quality (unevenness in density) | Unevenness in glossiness | Remark |
|---|---|---|---|---|---|---|---|
| Experiment 6-1 | Absence | Absence | — | x | Δ | ○ | Comparative Example |
| Experiment 6-2 | Presence | Absence | 5 minutes | ○ | ○ | Δ | Example |
| Experiment 6-3 | Presence | Absence | 30 minutes | ○ | ○ | ○ | Example |
| Experiment 6-4 | Presence | Presence | 5 minutes | ○ | ○ | ○ | Example |
| Experiment 6-5 | Absence | Presence | — | x | x | x | Comparative Example |

[Image Formation and Image Evaluation]

Each active ray-curable inkjet ink described above was charged in a line type inkjet printer. The temperature of the inkjet recording head of the inkjet printer was set to 80° C. As an inkjet recording head, a piezo head having a nozzle diameter of 20 μm, the nozzle number of 512 nozzles (256 nozzles×2 rows, staggered arrangement, nozzle pitch per row: 360 dpi) was used. The drop volume of one droplet was set to 2.5 pl, a droplet ejection speed was set to about 6 m/s, a resolution was set to 1440 dpi×1440 dpi, and a recording speed was set to 500 mm/s. The image was formed under an environment at 23° C. and 55% RH. The term dpi represents the number of dots per 2.54 cm.

A solid image having a size of 5 cm×5 cm was printed by the inkjet printer on a PET (polyethylene terephthalate) film that has been subjected to corona treatment immediately before printing. After the image was formed, the image was irradiated with UV rays using an LED lamp (manufactured by Phoseon Technology, 395 nm, water-cooled LED) disposed at the downstream side of the recording apparatus so as to cure the ink. The accumulated amount of light at the time of irradiation was set to 200 mJ.

(Evaluation of Unevenness in Density)

The unevenness in density of the solid image having a size of 5 cm×5 cm that was printed on the PET film was visually evaluated. The evaluation was performed based on the following criteria. The results thereof are presented in Tables 2 to 7.

○: No unevenness in density in the image is recognized when the image is observed at a position 15 cm apart from the image.

Δ: Unevenness in density in a part of the image is recognized when the image is observed at a position 15 cm apart from the image, while no unevenness in density is recognized when the image is observed at a position 30 cm apart from the image.

x: Unevenness in density in the image is recognized when the image is observed at a position 30 cm apart from the image.

(Evaluation of Unevenness in Glossiness)

The glossiness of the sample used in the evaluation of unevenness in density was visually observed.

○: No unevenness in glossiness is recognized even when viewed from any angles, when the sample is observed at a position 15 cm apart from the sample.

Δ: Unevenness in glossiness is slightly recognized when the sample is observed at a position 15 cm apart from the sample.

x: Unevenness in glossiness is recognized when the sample is observed at a position 30 cm apart from the sample.

As presented in Tables 2 to 7, in Experiment 2 to Experiment 4, favorable results were obtained with respect to all evaluation items. In addition, in Experiments 1 and 5 in which the shearing was not performed by using a shearing device, the image quality was poor in Experiment 1 and unevenness in glossiness occurred in Experiment 5. From the results of Experiment 1 to Experiment 5, it was found that, when the shearing is performed at the time of sending the liquid, it is possible to achieve the enhancement of the liquid sending property and the improvement of image quality and unevenness in glossiness.

Example 2

The ink of Sample 1 prepared in Example 1 was charged in cylindrical ink tanks (the ink storage units) each having a different size and sheared by rotating the rotating blade. The ink was sheared while the radius of the rotating blade, the distance between the rotating blade and the container bottom, and the circumferential velocity of the rotating blade were changed variously, and an image was formed in the same method as in Example 1 while the ink which had been sheared for a predetermined period of time was heated to 80° C. The shearing time until an image with a result of unevenness in glossiness of ○ is obtained under each condition is presented in Table 8.

TABLE 8

| | Container inner diameter (cm) | Radius of rotating blade (cm) | Distance between rotating blade and container bottom (cm) | Circumferential velocity (rpm) | r/R | r/d | Shearing time (minute) | Remark |
|---|---|---|---|---|---|---|---|---|
| Experiment 11 | 20 | 9 | 1 | 200 | 0.45 | 9.0 | 80 | Example |
| Experiment 12 | 20 | 12.5 | 1 | 200 | 0.63 | 12.5 | 50 | Example |
| Experiment 13 | 20 | 15 | 1 | 200 | 0.75 | 15.0 | 30 | Example |
| Experiment 14 | 20 | 15 | 1 | 200 | 0.80 | 16.0 | 28 | Example |
| Experiment 15 | 12 | 9 | 1 | 200 | 0.75 | 9.0 | 30 | Example |
| Experiment 21 | 20 | 15 | 0.25 | 200 | 0.75 | 60.0 | 49 | Example |
| Experiment 22 | 20 | 15 | 0.35 | 200 | 0.75 | 42.9 | 29 | Example |
| Experiment 23 | 20 | 15 | 0.55 | 200 | 0.75 | 27.3 | 30 | Example |
| Experiment 24 | 20 | 15 | 1 | 200 | 0.75 | 15.0 | 30 | Example |
| Experiment 25 | 20 | 15 | 3 | 200 | 0.75 | 5.0 | 45 | Example |
| Experiment 26 | 20 | 15 | 4 | 200 | 0.75 | 3.8 | 70 | Example |
| Experiment 31 | 20 | 15 | 1 | 80 | 0.75 | 15.0 | 85 | Example |
| Experiment 32 | 20 | 15 | 1 | 120 | 0.75 | 15.0 | 60 | Example |
| Experiment 33 | 20 | 15 | 1 | 200 | 0.75 | 15.0 | 30 | Example |
| Experiment 34 | 20 | 15 | 1 | 400 | 0.75 | 15.0 | 20 | Example |
| Experiment 35 | 20 | 15 | 1 | 550 | 0.75 | 15.0 | 18 | Example |
| Experiment 36 | 20 | 15 | 1 | 650 | 0.75 | 15.0 | 16 | Example |

As presented in Table 8, in Experiment 11 to Experiment 15, when r/R was equal to or more than 0.5, an image with small unevenness in glossiness was obtained even in a shorter shearing time. In Experiment 21 to Experiment 25, when r/d was 2 to 50, an image with small unevenness in glossiness was obtained even in a shorter shearing time. In addition, in Experiment 21, a trouble in which the rotating blade came into contact with the bottom portion of the tank due to the deviation of the rotating blade during rotating occurred. In Experiment 31 to Experiment 35, when the circumferential velocity of the rotating blade was 100 rpm to 600 rpm, an image with small unevenness in glossiness was obtained even in a shorter shearing time. However, in Experiment 36, liquid splash occurred and thus the contamination of the surrounding area occurred.

INDUSTRIAL APPLICABILITY

According to the invention, there is provided an inkjet printer used for an ink having a high viscosity in which the viscosity at 25° C. is 5000 mPa·s or more. Since the ink can be sent by using a general liquid sending pump, it is possible to reduce the production cost of the inkjet printer.

REFERENCE SIGNS LIST

H INK HEAD
P INK SUPPLY UNIT
T INK STORAGE UNIT
S INK HEATING UNIT
50 SHEARING DEVICE
50*a* ROTATION AXIS
50*b* ROTATING BLADE
52 CONTAINER
1 INKJET PRINTER
10, 20 INKJET PRINTER
12 RECORDING MEDIUM
14, 24 INKJET RECORDING HEAD
16, 26 HEAD CARRIAGE
18, 28 ACTIVE RAY IRRADIATION UNIT
19 TEMPERATURE CONTROL UNIT
27 GUIDE PORTION

The invention claimed is:

1. An inkjet printer comprising:
an ink head ejecting an ink;
an ink supply unit communicating with the ink head; and
an ink storage unit communicating with the ink supply unit and supplying the ink to the ink head through the ink supply unit, wherein
the ink supply unit has an ink heating unit that heats the ink until a viscosity of the ink is within the range of 5 mPa·s or more to 30 mPa·s or less,
the ink storage unit has a shearing device that shears the ink,
the ink storage unit includes a shearing device that has a rotation axis and a rotating blade provided at one end of the rotation axis and a container that accommodates the ink, and
the container is a substantially cylindrical container, and when a radius of a circle obtained by cutting the container in a horizontal direction with respect to a bottom surface is designated as R and a distance from the rotation axis to a leading end of the rotating blade is designated as r, r/R is equal to or more than 0.5.

2. The inkjet printer according to claim 1, being used for an ink having a viscosity at 25° C. of 5000 mPa·s or more.

3. The inkjet printer according to claim 2, wherein the shearing device decreases the viscosity of the ink to ⅕ or less of the viscosity of the ink before shearing.

4. The inkjet printer according to claim 2, wherein the ink contains a photopolymerizable compound, a photopolymerization initiator, and a gelling agent, and undergoes temperature-induced sol-gel phase transition.

5. The inkjet printer according to claim 1, wherein r/R is 0.60 to 0.77.

6. The inkjet printer according to claim 1, wherein, when the distance from the rotation axis to the leading end of the rotating blade is designated as r and a distance from the rotating blade to the bottom surface of the container is designated as d, r/d is 2 to 50.

7. The inkjet printer according to claim 6, wherein r/d is 4 to 30.

8. The inkjet printer according to claim 1, wherein a circumferential velocity of the rotating blade is 100 rpm to 600 rpm.

9. The inkjet printer according to claim 1, wherein the shearing device decreases the viscosity of the ink to ⅕ or less of the viscosity of the ink before shearing.

10. The inkjet printer according to claim 1, wherein the ink contains a photopolymerizable compound, a photopolymerization initiator, and a gelling agent, and undergoes temperature-induced sol-gel phase transition.

11. An image formation method comprising, in the following order:
a step of shearing an active ray-curable inkjet ink in an ink storage unit;
a step of supplying the sheared active ray-curable inkjet ink to an ink head while the sheared active ray-curable inkjet ink is heated such that a viscosity of the ink is within the range of 5 mPa·s or more to 30 mPa·s or less;
a step of ejecting the active ray-curable inkjet ink to a recording medium; and
a step of curing the ink by irradiating the ink landed on the recording medium with an active ray,
wherein the ink storage unit includes a shearing device that has a rotation axis and a rotating blade provided at one end of the rotation axis and a container that accommodates the ink, and
the container is a substantially cylindrical container, and when a radius of a circle obtained by cutting the container in a horizontal direction with respect to a bottom surface is designated as R and a distance from the rotation axis to a leading end of the rotating blade is designated as r, r/R is equal to or more than 0.5.

12. The image formation method according to claim 11, wherein a viscosity at 25° C. of the active ray-curable inkjet ink is 5000 mPa·s.

13. The image formation method according to claim 11, wherein a circumferential velocity of the rotating blade is 100 rpm to 600 rpm.

14. The image formation method according to claim 11, wherein the shearing step decreases the viscosity of the ink to ⅕ or less of the viscosity of the ink before shearing.

* * * * *